US011442381B2

(12) United States Patent
Yamagishi et al.

(10) Patent No.: US 11,442,381 B2
(45) Date of Patent: Sep. 13, 2022

(54) IMAGE FORMING APPARATUS

(71) Applicant: FUJIFILM Business Innovation Corp., Tokyo (JP)

(72) Inventors: Kazunari Yamagishi, Kanagawa (JP); Akira Shimodaira, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/316,819

(22) Filed: May 11, 2021

(65) Prior Publication Data

US 2022/0128934 A1 Apr. 28, 2022

(30) Foreign Application Priority Data

Oct. 27, 2020 (JP) ..... JP2020-179357

(51) Int. Cl.
*G03G 15/16* (2006.01)
*G03G 21/12* (2006.01)
*G03G 15/08* (2006.01)

(52) U.S. Cl.
CPC ..... *G03G 15/161* (2013.01); *G03G 15/0849* (2013.01); *G03G 21/12* (2013.01)

(58) Field of Classification Search
CPC ... G03G 21/12; G03G 15/0849; G03G 15/161
See application file for complete search history.

(56) References Cited

U.S. PATENT DOCUMENTS

2012/0328309 A1* 12/2012 Kihara ..... G03G 21/10 399/35
2020/0409289 A1* 12/2020 Nakayashiki ..... G03G 21/105

FOREIGN PATENT DOCUMENTS

JP 2007-140332 A 6/2007

* cited by examiner

*Primary Examiner* — Clayton E. LaBalle
*Assistant Examiner* — Michael A Harrison
(74) *Attorney, Agent, or Firm* — Sughrue Mion, PLLC

(57) ABSTRACT

An image forming apparatus includes: an image carrier that carries an image; a developing device that develops a latent image formed on the image carrier into a visible image formed of powder; an intermediate transfer body to which the visible image is transferred from the image carrier and that temporarily transports the visible image; a transfer device that transfers the visible image on the image carrier to the intermediate transfer body; a first cleaning device that cleans the image carrier by collecting powder that remains on the image carrier; a first collection container that receives the powder collected by the first cleaning device; a second cleaning device that cleans the intermediate transfer body by collecting powder that remains on the intermediate transfer body; a second collection container that receives the powder collected by the second cleaning device; a feeding device that supplies a transfer-process bias to the transfer device; and a changing unit that changes the transfer-process bias supplied by the feeding device when a waste powder image is formed on the image carrier, the transfer-process bias being changed so as to adjust amounts of powder in the waste powder image received by the first collection container and the second collection container.

23 Claims, 19 Drawing Sheets

FIG. 6A

| FIRST-TRANSFER-PROCESS CURRENT | CHANGE | |
|---|---|---|
| | FIRST TRANSFER CURRENT | SECOND TRANSFER CURRENT |
| I (Y) | +α | 0 (OUTPUT OFF) |
| I (M) | +α | 0 |
| I (C) | +α | 0 |
| I (K) | +α | 0 |

FIG. 6B

| COLLECTION CONTAINER | RECEPTION RATIO | |
|---|---|---|
| | FIRST TRANSFER CURRENT | SECOND TRANSFER CURRENT |
| FIRST COLLECTION CONTAINER 61Y | 10% | 30% |
| FIRST COLLECTION CONTAINER 61M | 10% | 30% |
| FIRST COLLECTION CONTAINER 61C | 10% | 30% |
| FIRST COLLECTION CONTAINER 61K | 20% | 30% |
| SECOND COLLECTION CONTAINER 65 | 90% (80%) | 70% (70%) |

FIG. 8A

| FIRST-TRANSFER-PROCESS CURRENT | CHANGE | |
|---|---|---|
| | FIRST TRANSFER CURRENT | SECOND TRANSFER CURRENT |
| I (Y) | +α | 0 (OUTPUT OFF) |
| I (M) | +α | 0 |
| I (C) | +α | 0 |
| I (K) | +α | 0 |

FIG. 8B

| COLLECTION CONTAINER | RECEPTION RATIO | |
|---|---|---|
| | FIRST TRANSFER CURRENT | SECOND TRANSFER CURRENT |
| FIRST COLLECTION CONTAINER 61Y | 10% | 30% |
| FIRST COLLECTION CONTAINER 61M | 10% | 30% |
| FIRST COLLECTION CONTAINER 61C | 10% | 30% |
| FIRST COLLECTION CONTAINER 61K | 20% | 30% |
| SECOND COLLECTION CONTAINER 65 | 90% (80%) | 70% (70%) |

FIG. 13A

| FIRST-TRANSFER-PROCESS CURRENT | CHANGE | |
|---|---|---|
| | FIRST TRANSFER CURRENT | SECOND TRANSFER CURRENT |
| I (Y) | $+\beta$ ($< \alpha$) | $-\beta$ |
| I (M) | $+\beta$ | $+\beta$ |
| I (C) | $+\beta$ | $+\beta$ |
| I (K) | $+\beta$ | $+\beta$ |

FIG. 13B

| COLLECTION CONTAINER | RECEPTION RATIO | |
|---|---|---|
| | FIRST TRANSFER CURRENT | SECOND TRANSFER CURRENT |
| FIRST COLLECTION CONTAINER 61Y | 10% | 70% |
| FIRST COLLECTION CONTAINER 61M | 10% | 10% |
| FIRST COLLECTION CONTAINER 61C | 10% | 10% |
| FIRST COLLECTION CONTAINER 61K | 70% | 10% |

IMAGE FORMING APPARATUS

CROSS-REFERENCE TO RELATED APPLICATIONS

This application is based on and claims priority under 35 USC 119 from Japanese Patent Application No. 2020-179357 filed Oct. 27, 2020.

BACKGROUND

(i) Technical Field

The present disclosure relates to an image forming apparatus.

(ii) Related Art

Japanese Unexamined Patent Application Publication No. 2007-140332 (claim 2 and FIGS. 2 and 3) describes a toner supplying-and-collecting mechanism of an electrophotographic image forming apparatus that uses toners of different colors, and a visual image forming apparatus including the toner supplying-and-collecting mechanism. The toner supplying-and-collecting mechanism includes a waste toner buffer container for collecting toners that have not been transferred in an electrophotographic image forming process at a single location; a plurality of collected-toner transport units that transport toners collected from drum cleaner units and an ITB cleaner unit to the waste toner buffer container; and a collected-toner distribution unit that distributes the toners collected in the waste toner buffer container in accordance with a new-toner supply ratio.

SUMMARY

Aspects of non-limiting embodiments of the present disclosure relate to an image forming apparatus that includes a plurality of collection containers for receiving collected powder and that is capable of adjusting the time of replacement of at least one of the collection containers unlike when the amounts of powder received by the collection containers are not controlled.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image carrier that carries an image; a developing device that develops a latent image formed on the image carrier into a visible image formed of powder; an intermediate transfer body to which the visible image is transferred from the image carrier and that temporarily transports the visible image; a transfer device that transfers the visible image on the image carrier to the intermediate transfer body; a first cleaning device that cleans the image carrier by collecting powder that remains on the image carrier; a first collection container that receives the powder collected by the first cleaning device; a second cleaning device that cleans the intermediate transfer body by collecting powder that remains on the intermediate transfer body; a second collection container that receives the powder collected by the second cleaning device; a feeding device that supplies a transfer-process bias to the transfer device; and a changing unit that changes the transfer-process bias supplied by the feeding device when a waste powder image is formed on the image carrier, the transfer-process bias being changed so as to adjust amounts of powder in the waste powder image received by the first collection container and the second collection container.

BRIEF DESCRIPTION OF THE DRAWINGS

Exemplary embodiments of the present disclosure will be described in detail based on the following figures, wherein:

FIG. 6A is a table showing changes made by the changing unit of the visual image forming apparatus illustrated in FIGS. 1A and 1B;

FIG. 6B is a table showing reception ratios of collection containers corresponding to the changes illustrated in FIG. 6A;

FIG. 8A is a table showing changes made by a changing unit of a modification of the visual image forming apparatus illustrated in FIGS. 1A and 1B;

FIG. 8B is a table showing reception ratios of collection containers corresponding to the changes illustrated in FIG. 8A;

FIG. 13A is a table showing changes made by the changing unit of the visual image forming apparatus illustrated in FIG. 10;

FIG. 13B is a table showing reception ratios of collection containers corresponding to the changes illustrated in 13A;

DETAILED DESCRIPTION

Exemplary embodiments for carrying out the present disclosure (referred to simply as "exemplary embodiments" in this specification) will now be described with reference to the drawings.

First Exemplary Embodiment

Figure 1A:
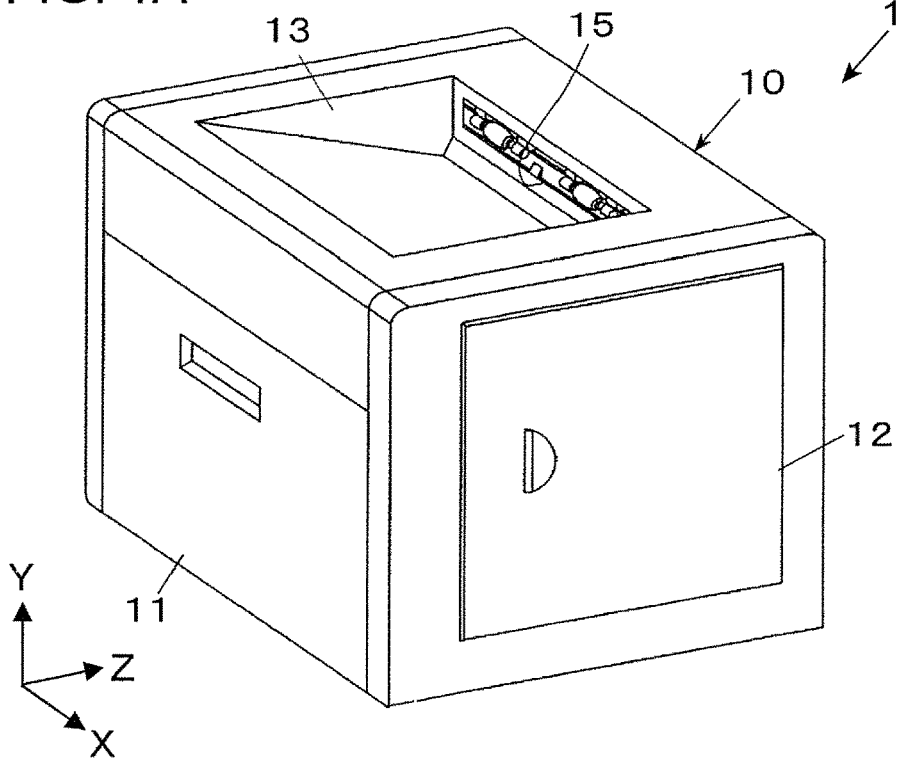
FIG. 1A is a perspective view illustrating the appearance of a visual image forming apparatus according to a first exemplary embodiment.
Figure 1B:
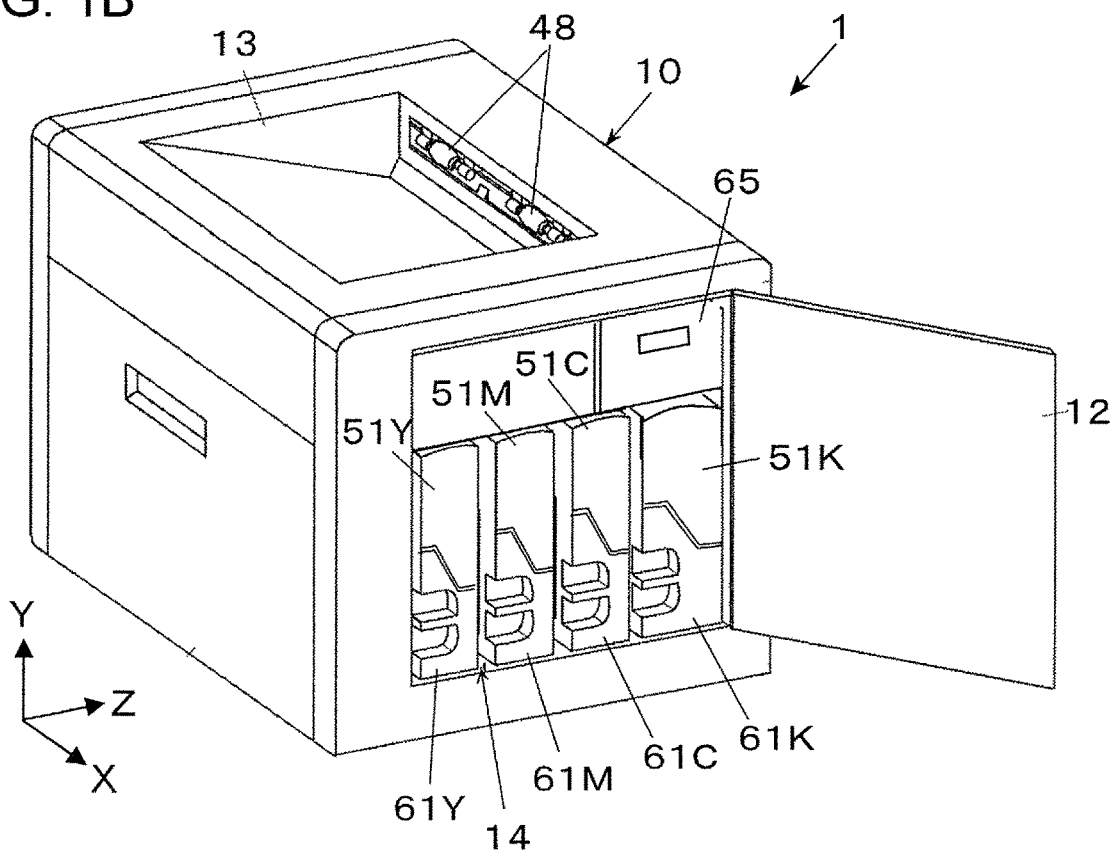
FIG. 1B is a perspective view of the visual image forming apparatus illustrated in FIG. 1A in a state in which a side covering is opened.
Figure 2:
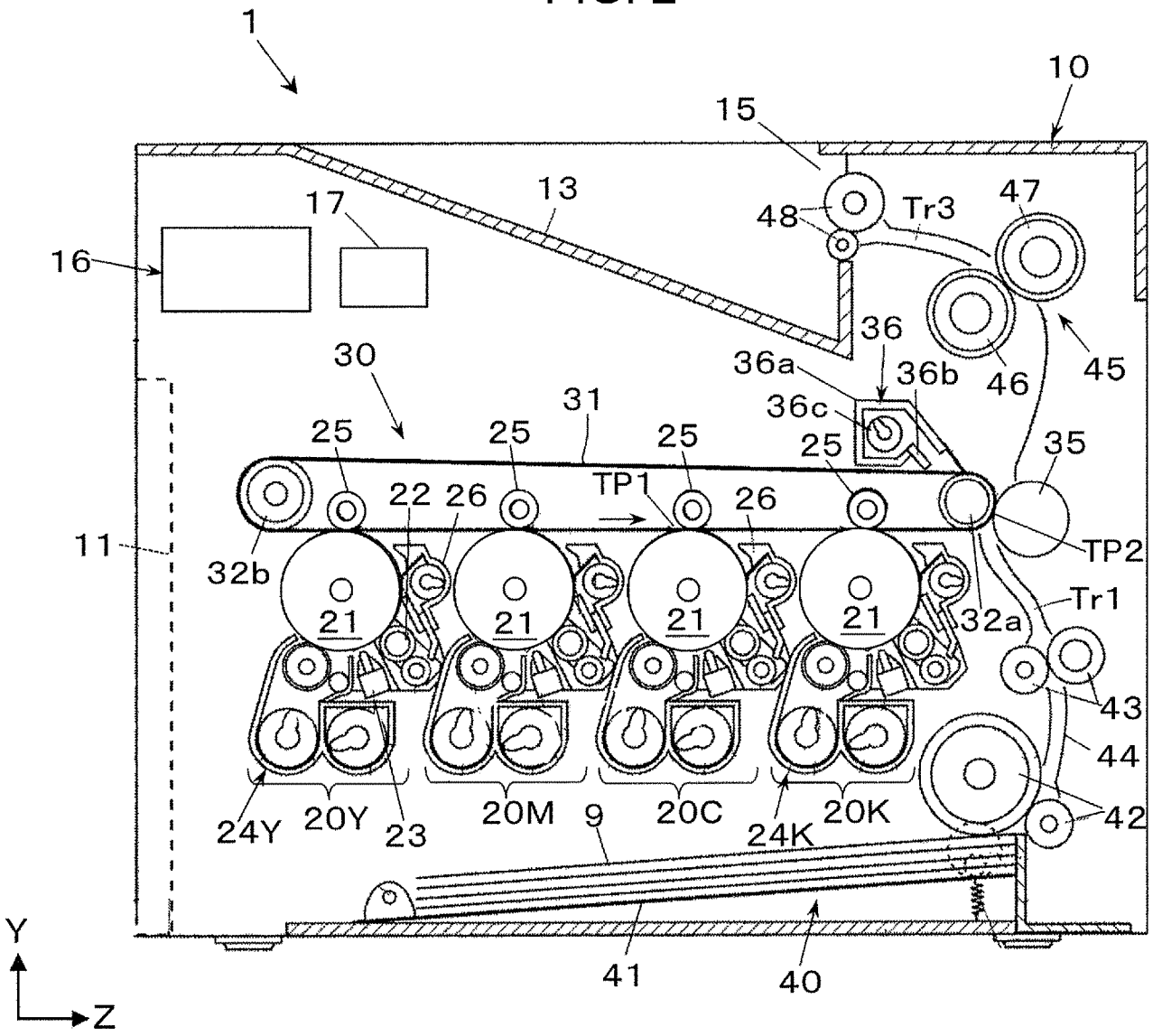
FIG. 2 illustrates the internal structure of the visual image forming apparatus illustrated in FIGS. 1A and 1B.

FIGS. 1A, 1B, and FIG. 2 illustrate a visual image forming apparatus 1 as an example of an image forming apparatus according to a first exemplary embodiment. FIGS. 1A and 1B illustrate the appearance of the visual image forming apparatus 1, and FIG. 2 illustrates the internal structure of the visual image forming apparatus 1.

In the following description, the direction shown by arrow X in the drawings is defined as the width direction of the apparatus, the direction shown by arrow Y as the height direction of the apparatus, and the direction shown by arrow Z as the depth direction of the apparatus that is orthogonal to both the width direction and the height direction.

Overall Structure of Visual Image Forming Apparatus

The visual image forming apparatus 1 is an apparatus that forms a visible image formed of developer, which is an example of powder, on a paper sheet 9, which is an example of a sheet-shaped object or a recording medium. The visual image forming apparatus 1 according to the first exemplary embodiment is configured as, for example, a printer that forms an image, which is a visible image corresponding to image information input from an external connection device, such as an information terminal or a personal computer. The developer may be, for example, two-component developer containing non-magnetic toner and magnetic carrier. The image information is, for example, information relating to images including texts, graphics, pictures, and patterns.

As illustrated in FIGS. 1A and 1B, the visual image forming apparatus 1 includes a housing 10 having a box-shaped appearance. The housing 10 is formed of materials including support frames and external panels.

The housing 10 includes a front cover 11 that opens and closes on the front, and a side covering 12 that opens and closes on the right side. An output receiver 13 that receives a paper sheet 9 output after an image is formed thereon is provided at the top of the housing 10.

As illustrated in FIG. 1B, the housing 10 has a container attachment unit 14, to which various replaceable containers are removably attached, at a location accessible when the side covering 12 is opened.

The above-described containers include, for example, replaceable (cartridge) developer containers 51, which are examples of a powder container containing developer including toner to be supplied; first collection containers 61, which receive developer including toner collected by first cleaning devices 26, which will be described below; and a second collection container 65, which receives developer including toner collected by a second cleaning device 36, which will be described below.

The developer containers 51 include four developer containers 51Y, 51M, 51C, and 51K dedicated to contain respective ones of toners of four colors described below. The first collection containers 61 include four first collection containers 61Y, 61M, 61C, and 61K that separately receive developers collected by respective ones of the first cleaning devices 26, which are individually included in four image forming devices 20 (Y, M, C, and K) described below.

As illustrated in FIG. 2, the visual image forming apparatus 1 includes the image forming devices 20, an intermediate transfer device 30, a sheet supplying device 40, a fixing device 45, and a control device 16, which are disposed in the space inside the housing 10. The image forming devices 20 form visible images based on the image information. The intermediate transfer device 30 temporarily holds the visible images formed by the image forming devices 20, and transfers the visible images onto the paper sheet 9 in a second transfer process. The sheet supplying device 40 contains the paper sheet 9 to be supplied to a second transfer position of the intermediate transfer device 30, and supplies the paper sheet 9. The fixing device 45 fixes the visible images transferred by the intermediate transfer device 30 in the second transfer process to the paper sheet 9. The control device 16 controls, for example, the operation of each device. The visual image forming apparatus 1 is a visual image forming apparatus that uses an intermediate transfer method.

The control device 16 includes an arithmetic processing device, a storage element, a storage device, and an input/output device. The control device 16 operates in response to, for example, various detection information or operation commands based on control programs and control data stored in, for example, the storage element, and controls operations of devices and equipment to be controlled.

The image forming devices 20 include four image forming devices 20Y, 20M, 20C, and 20K dedicated to form visible images of four colors, which are yellow (Y), magenta (M), cyan (C), and black (K) by, for example, an electrophotographic method.

Each of the four image forming devices 20 (Y, M, C, and K) includes a drum-shaped photoconductor 21, which is an example of an image carrier and is rotated in the direction of arrow A. Devices including a charging device 22, an exposure device 23, a developing device 24 (Y, M, C, K), a first transfer device 25, and a first cleaning device 26 are arranged around each photoconductor 21. In FIG. 2, the reference numerals from 21 to 26 are shown for all of the respective components of the image forming device 20Y for yellow (Y), but are shown for only some of the respective components of the image forming devices 20 for other colors (M, C, and K).

The image forming devices 20 (Y, M, C, and K) are arranged in a transporting direction (rotation direction) of an intermediate transfer belt 31 (described below) of the intermediate transfer device 30.

The charging devices 22 are devices that charge outer peripheral surfaces (surfaces on which images may be formed) of the photoconductors 21 to a predetermined surface potential. The exposure devices 23 are devices that form electrostatic latent images by exposing the outer peripheral surfaces of the photoconductors 21 to light corresponding to image signals of color components (Y, M, C, and K) generated based on the image information. The image signals are obtained through an image processing device 17 connected to the control device 16.

The developing devices 24 (Y, M, C, and K) are devices that develop the electrostatic latent images formed on the outer peripheral surfaces of the respective photoconductors 21 with developers including toners of the respective colors (Y, M, C, and K) to form toner images, which are visible images.

The developing devices 24 (Y, M, C, and K) differ only in the color of the developer used therein, and the structures thereof are the same in other respects.

Figure 3:
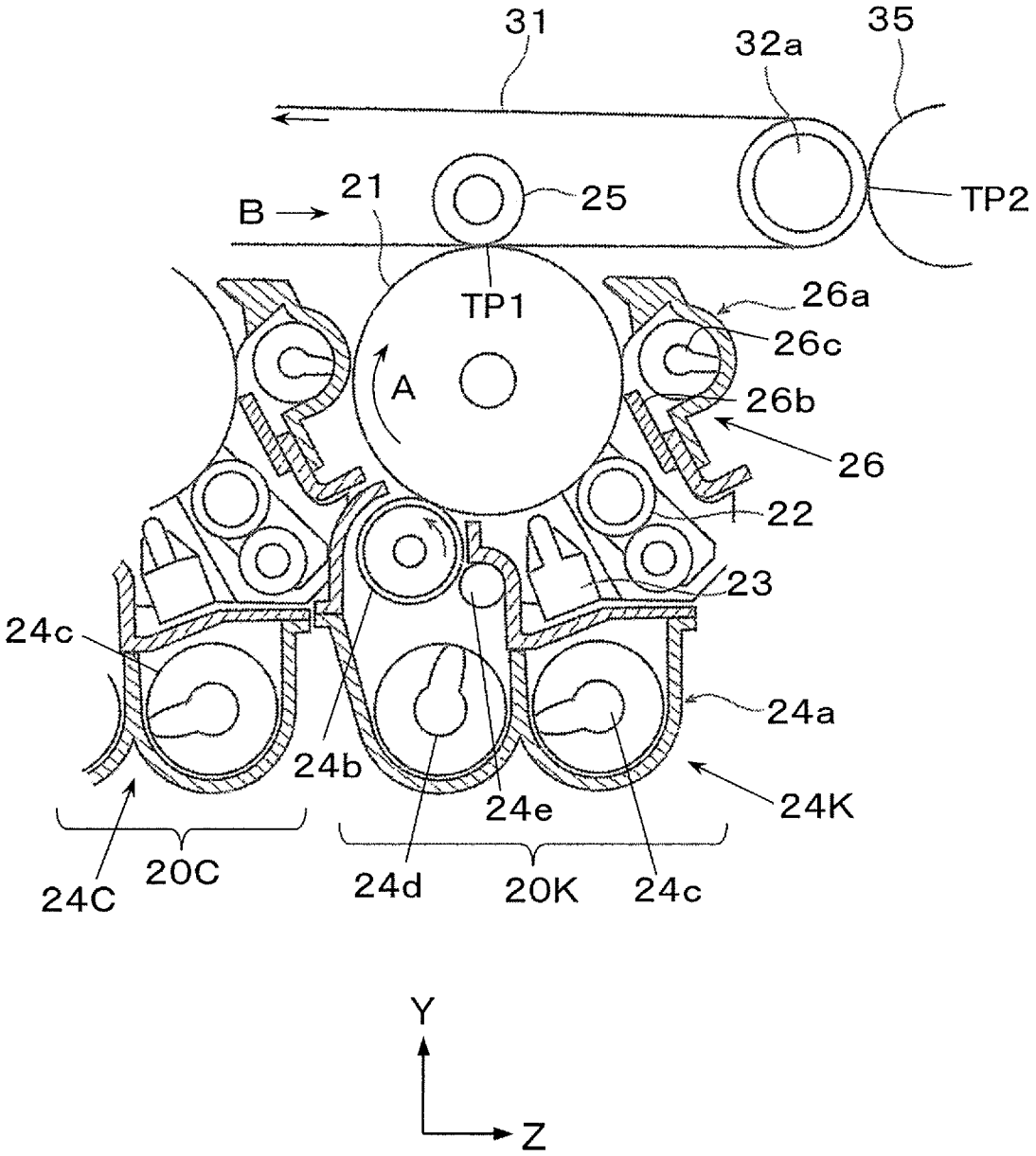
FIG. 3 illustrates image forming devices and other components included in the visual image forming apparatus illustrated in FIGS. 1A and 1B.

More specifically, referring to FIG. 3, which illustrates the developing device 24K as a representative example of the developing devices 24 (Y, M, C, and K), each of the developing devices 24 (Y, M, C, and K) includes a container-shaped housing 24*a* that has a developer-containing chamber and a developer opening and in which components including a developing roller 24*b*, stirring-and-transporting members 24*c* and 24*d*, and an adjustment member 24*e* are disposed. The developing roller 24*b* holds the developer and supplies the developer to a developing region of the photoconductor 21 that faces the developer opening. The stirring-and-transporting members 24*c* and 24*d* are, for example, screw augers that transport the developer contained in the developer-containing chamber of the housing 24*a* while stirring the developer. The adjustment member 24*e* adjusts the amount of developer held by the developing roller 24*b* (layer thickness).

The developing device 24K will be described as a representative example of the developing devices 24 (Y, M, C, and K). The stirring-and-transporting members 24*c* and 24*d* stir black toner to charge the black toner by friction, and the charged black toner electrostatically adheres to the electrostatic latent image on the photoconductor 21 from the developing roller 24*b*. Thus, the electrostatic latent image is developed into a black toner image, which is a visible image.

Figure 5:
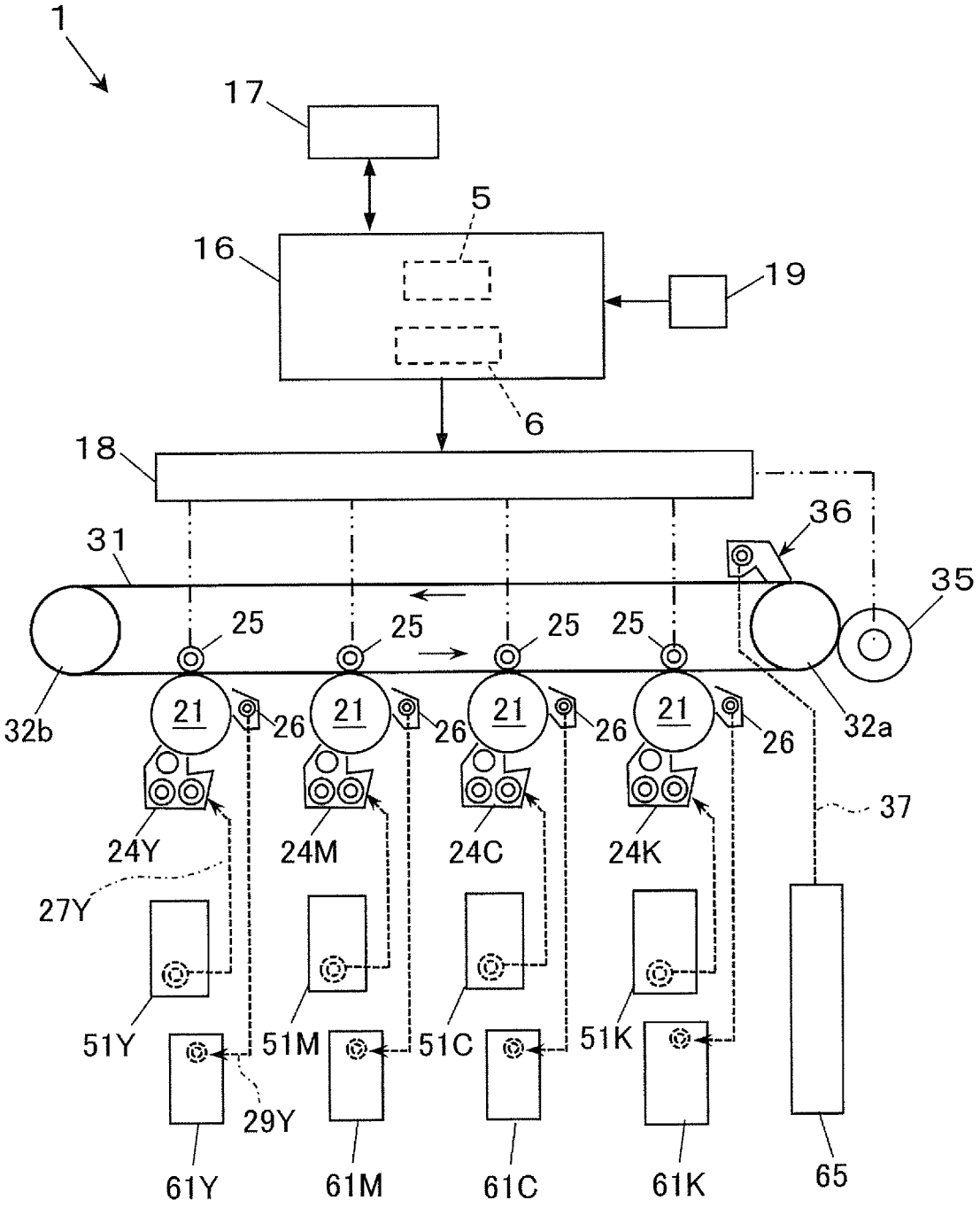
FIG. 5 is a schematic diagram illustrating the structure related to a changing unit included in the visual image forming apparatus illustrated in FIGS. 1A and 1B.

The first transfer devices 25 are devices that basically electrostatically transfer toner images of the respective colors to the intermediate transfer device 30 (intermediate transfer belt 31). Referring to FIGS. 3 and 5, in the first exemplary embodiment, each first transfer device 25 is a contact transfer device including a first transfer roller, which is an example of a contact transfer member to which a first-transfer-process bias is supplied. As illustrated in FIG. 5, the first transfer roller of each first transfer device 25 receives a predetermined first-transfer-process bias from a feeding device 18.

The first cleaning devices 26 are devices that clean the outer peripheral surfaces of the respective photoconductors 21 by scraping off unnecessary substances, such as unnecessary toners and paper dust, from the outer peripheral surfaces of the photoconductors 21. Each first cleaning device 26 includes a container body 26*a* in which components including a contact cleaning member 26*b* and a transport member 26*c* are disposed. The contact cleaning member 26*b* scrapes off the unnecessary substances including toners. The transport member 26*c* is, for example, a screw auger that collects the unnecessary substances scraped off by the contact cleaning member 26*b* and transports the unnecessary substances to the corresponding one of the above-described first collection containers 61 (Y, M, C, and K).

The image forming devices 20 (Y, M, C, and K) each have a first transfer position TP1 at which the photoconductor 21 faces the first transfer roller of the first transfer device 25 (with the intermediate transfer belt 31 interposed therebetween) and at which a first transfer process is performed on a toner image.

When the control device 16 is instructed to carry out image formation by the external connection device connected to the visual image forming apparatus 1 and receives a command for an image forming operation, each of the image forming devices 20 (Y, M, C, and K) forms a toner image of one of the four colors (Y, M, C, and K) on the photoconductor 21 thereof. The thus-formed toner image is transferred onto the intermediate transfer belt 31 of the intermediate transfer device 30 at the corresponding first transfer position TP1 in the first transfer process.

The intermediate transfer device 30 is a device that receives the toner images of the respective colors formed by the image forming devices 20 (Y, M, C, and K) in the first transfer process, transports the toner images to the second transfer position at which the toner images are to be transferred to the paper sheet 9, and then transfers the toner images to the paper sheet 9 in the second transfer process.

The intermediate transfer device 30 of the first exemplary embodiment is disposed above the image forming devices 20 (Y, M, C, and K) in the housing 10. As illustrated in FIGS. 2 and 3, the intermediate transfer device 30 includes the intermediate transfer belt 31, which is an example of an intermediate transfer body that holds the toner images transferred thereto from the photoconductors 21 of the image forming devices 20 (Y, M, C, and K) in the first transfer process. Devices described below are arranged around the intermediate transfer belt 31.

The intermediate transfer belt 31 is an endless belt capable of holding the toner images basically electrostatically, and is supported by a plurality of support rollers 32 (for example, two support rollers 32*a* and 32*b*) disposed inside the intermediate transfer belt 31 so that the intermediate transfer belt 31 rotates (circulates) in the direction of arrow B while successively passing through the first transfer positions TP1 of the image forming devices 20 (Y, M, C, and K). One of the support rollers 32*a* and 32*b* is configured as a driving roller. Another one of the support rollers 32*a* and 32*b* is configured as a tension roller that applies tension to the intermediate transfer belt 31.

The first transfer rollers of the first transfer devices 25 for the image forming devices 20 (Y, M, C, and K) are disposed inside the intermediate transfer belt 31. The first transfer rollers of the first transfer devices 25 rotate while pressing the intermediate transfer belt 31 against the photoconductors 21. The first transfer devices 25 constitute portions of the intermediate transfer device 30.

A second transfer device 35 is disposed on an outer peripheral surface of a portion of the intermediate transfer belt 31 that is supported by the support roller 32*a*. The second transfer device 35 causes the paper sheet 9 to pass therethrough while transferring the toner images on the intermediate transfer belt 31 to the paper sheet 9 in the second transfer process. The second transfer device 35 of the first exemplary embodiment is a contact transfer device including a second transfer roller, which is an example of a contact transfer member to which a second-transfer-process bias is supplied. The second transfer device 35 is configured to pass the paper sheet 9 therethrough such that the second transfer roller thereof presses the paper sheet 9 against the outer peripheral surface of the portion of the intermediate transfer belt 31 supported by the support roller 32*a*. As illustrated in FIG. 5, the second transfer roller of the second transfer device 35 receives a predetermined second-transfer-process bias from the feeding device 18.

The second cleaning device 36 is disposed outside the intermediate transfer belt 31. The second cleaning device 36 cleans the outer peripheral surface of the intermediate transfer belt 31 by removing unnecessary substances, such as unnecessary toners, that remain on the outer peripheral surface of the intermediate transfer belt 31 after the second transfer process. As illustrated in FIG. 2, the second cleaning device 36 includes a container body 36*a* in which components including a contact cleaning member 36*b* and a transport member 36*c* are disposed. The contact cleaning member 36*b* scrapes off the unnecessary substances including toners. The transport member 36*c* is, for example, a screw auger that collects the unnecessary substances scraped off by the contact cleaning member 36*b* and transports the unnecessary substances to the second collection container 65.

The intermediate transfer device 30 has a second transfer position TP2 at which the second transfer roller of the second transfer device 35 is in contact with the outer peripheral surface of the intermediate transfer belt 31 and at which the second transfer process is performed on the toner images.

When the toner images are transferred to the outer peripheral surface of the intermediate transfer belt 31 in the first transfer process during the image forming operation, the intermediate transfer device 30 transports the toner images to the second transfer position TP2 by rotating the intermediate transfer belt 31, and transfers the toner images to the paper sheet 9 in the second transfer process.

The sheet supplying device 40 is a device configured to store and supply the paper sheet 9 to be supplied to the second transfer position TP2 of the intermediate transfer device 30. The sheet supplying device 40 is disposed below the image forming devices 20 (Y, M, C, and K) in the housing 10.

The sheet supplying device 40 includes a container 41 that contains a stack of paper sheets 9 and that is capable of being pulled out, and a feeding device 42 that feeds the paper sheets 9 contained in the container 41 one at a time. The feeding device 42 includes a pair of transport rollers disposed at one end of the container 41 and a separating member (not illustrated).

As illustrated in FIG. 2, a supply transport path Tr1 along which each paper sheet 9 is transported and supplied to the second transfer position TP2 is disposed between the sheet supplying device 40 and the second transfer position TP2 of the intermediate transfer device 30. Components including a pair of transport rollers 43, between which the paper sheet 9 is held and transported, and guide members 44, which define a transport space for the paper sheet 9 and guide the paper sheet 9 that is transported, are arranged along the supply transport path Tr1.

The material, form, etc., of each paper sheet 9 used in the visual image forming apparatus 1 are not particularly limited as long as the paper sheet 9 is a recording medium such as plain paper, coated paper, or cardboard paper that is capable of being transported in the housing 10 and to which the toner images may be transferred and fixed.

The fixing device 45 is a device configured to fix the toner images transferred to the paper sheet 9 by the intermediate transfer device 30 in the second transfer process to the paper sheet 9. The fixing device 45 is disposed above the second transfer position TP2 of the intermediate transfer device 30 in the housing 10.

The fixing device 45 includes a housing (not illustrated) that has an introduction hole and an exit hole for the paper sheet 9 and in which components including a heating rotating body 46 and a pressing rotating body 47 are disposed. The heating rotating body 46 has the form of, for example, a roller and includes a heater (not illustrated). The pressing rotating body 47 has the form of, for example, a roller. The fixing device 45 includes a nip portion (fixing process portion) composed of portions of the heating rotating body 46 and the pressing rotating body 47 that are in contact with each other. The nip portion performs, for example, a heating and pressing process for fixing the unfixed toner images to the paper sheet 9.

In the image forming operation, the paper sheet 9 to which the toner images have been transferred at the second transfer position TP2 in the second transfer process is transported so that the paper sheet 9 is introduced into the nip portion and passes through the fixing device 45. Thus, the toner images on the paper sheet 9 are pressed and heated by the nip portion, and are thereby melted and fixed to the paper sheet 9.

As illustrated in FIG. 2, an output transport path Tr3 along which the paper sheet 9 is transported so as to be output to the output receiver 13 after the fixing process is provided between the fixing device 45 and an output hole 15 in the housing 10. Components including a pair of output rollers 48, which are located in front of the output hole 15, and guide members (not illustrated), which define a transport space for the paper sheet 9 and guide the paper sheet 9 that is transported, are arranged along the output transport path Tr3.

In the image forming operation, after the fixing process performed by the fixing device 45, the paper sheet 9 is transported along the output transport path Tr3, and is output to and received by the output receiver 13.

The visual image forming apparatus 1 is, for example, capable of selectively forming a multicolor image (full-color image), which is a combination of toner images of four colors (Y, M, C, and K) obtained by using all of the four image forming devices 20 (Y, M, C, and K), or a monochrome image (for example, a black-and-white image), which is a toner image of a single color obtained by using one of the four image forming devices 20 (Y, M, C, and K).

Structures Involving Supply of Toner

The visual image forming apparatus 1 is structured such that the developers (toners) in the developing devices 24 (Y, M, C, and K) are consumed to form images in the developing process, and the amounts thereof are reduced accordingly. Therefore, the toners contained in the developer containers 51 (Y, M, C, and K) are supplied to the developing devices 24 (Y, M, C, and K).

Accordingly, each of the developing devices 24 (Y, M, C, and K) includes a receiving unit located on an extension of the stirring-and-transporting member 24*c* toward the container attachment unit 14. The receiving unit has a receiving hole (not illustrated) for receiving the supplied toner and an openable lid.

Figure 4:
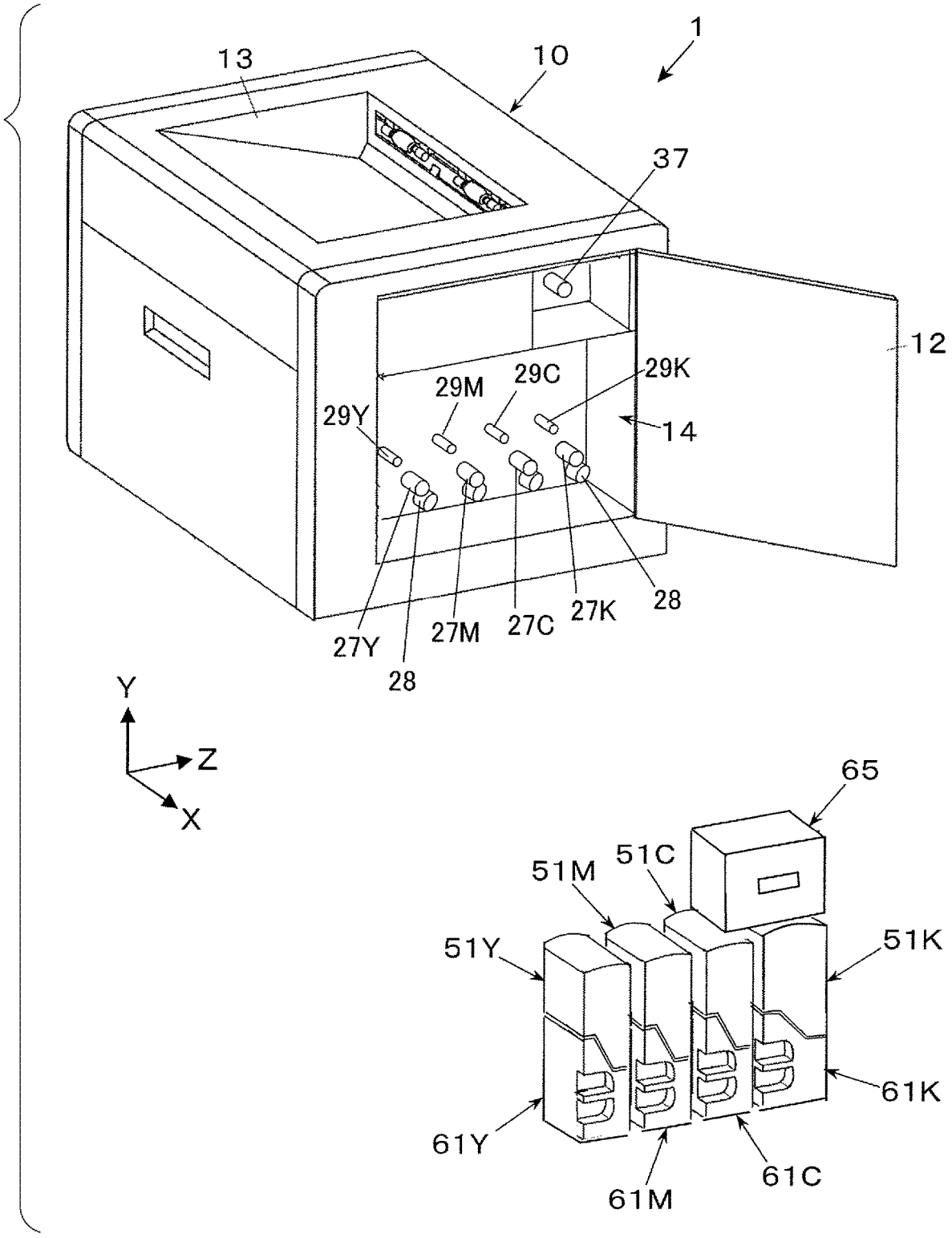
FIG. 4 is a perspective view of the visual image forming apparatus illustrated in FIGS. 1A and 1B in a state in which removable containers are removed.

As illustrated in FIG. 4, the container attachment unit 14 of the housing 10 includes supplying transport units 27 (Y, M, C, and K) and driving-force-transmitting units 28. The supplying transport units 27 (Y, M, C, and K) connect the receiving units of the developing devices 24 (Y, M, C, and K) to the respective developer containers 51 (Y, M, C, and K), and transport the toners to be supplied. The driving-force-transmitting units 28 transmit rotating force to discharging members (described below) disposed in the developer containers 51 (Y, M, C, and K).

As illustrated in FIG. 4, the supplying transport units 27 (Y, M, C, and K) and the driving-force-transmitting units 28 are arranged to project from the container attachment unit 14.

The supplying transport units 27 (Y, M, C, and K) include transport pipes that define transport spaces connecting the above-described receiving units to the developer containers 51 (Y, M, C, and K), and transport members that rotate in the transport pipes at an appropriate timing to transport the toners. Each of the supplying transport units 27 (Y, M, C, and K) has an end portion projecting into the container attachment unit 14 and having a receiving hole and an openable lid (not illustrated) on the upper surface thereof. Each of the driving-force-transmitting units 28 has an end portion that projects into the container attachment unit 14 and that has a connection gear (not illustrated) that is exposed.

The developer containers 51 (Y, M, C, and K), which are containers having certain shapes, include connecting portions having discharge holes and discharging members in lower sections thereof. The supplying transport units 27 (Y, M, C, and K) are inserted in and connected to the connecting portions. The discharging members are, for example, screw augers that are rotated to transport predetermined amounts of toners in the discharging portions of the containers to the supplying transport units 27 (Y, M, C, and K).

When the developer containers 51 (Y, M, C, and K) are attached to the container attachment unit 14, the supplying transport units 27 (Y, M, C, and K) are inserted in and connected to the connecting portions, and the discharging members are connected to the driving-force-transmitting units 28.

The control device 16 performs a control operation of activating the driving-force-transmitting units 28 for predetermined times in accordance with detection information, so that the discharging members of the developer containers 51 (Y, M, C, and K) are rotated by predetermined amounts to discharge the contained toners to the supply transport units 27 (Y, M, C, and K).

Accordingly, appropriate amounts of toners are transported and supplied to the developing devices 24 (Y, M, C, and K) from the corresponding developer containers 51 (Y, M, C, and K) through the supplying transport units 27 (Y, M, C, and K). The detection information used in this operation is, for example, detection information obtained by sensors that detect the amounts of toners in the developing devices 24 or detection information regarding toner images formed to detect density for the control operation.

Structures Involving Storage of Collected Toners

The visual image forming apparatus 1 is structured such that unnecessary substances including toners collected by the first cleaning devices 26 of the image forming devices 20 (Y, M, C, and K) are received by the first collection containers 61 (Y, M, C, and K), respectively.

Accordingly, the transport members 26*c* of the first cleaning devices 26 are disposed in first collecting transport units 29 (FIG. 4) that extend so as to project into the container attachment unit 14 in the housing 10 from the first cleaning devices 26. Each of the first collecting transport units 29 has an end portion projecting into the container attachment unit 14 and having a discharge hole and an openable lid (not illustrated) on the lower surface thereof.

The first collection containers 61 (Y, M, C, and K), which are containers having certain shapes, include connecting portions having collecting holes in upper sections thereof. The first collecting transport units 29 are inserted in and connected to the connecting portions.

The first collecting transport units 29 are inserted in and connected to the connecting portions of the first collection containers 61 (Y, M, C, and K) when the first collection containers 61 (Y, M, C, and K) are attached to the container attachment unit 14.

When the image forming devices 20 are in operation, unnecessary substances including toners that are collected by the first cleaning devices 26 are transported through the first collecting transport units 29 and received by the first collection containers 61 (Y, M, C, and K).

The visual image forming apparatus 1 is structured such that unnecessary substances including toners collected by the second cleaning device 36 of the intermediate transfer device 30 is received by the second collection container 65.

Accordingly, the transport member 36*c* of the second cleaning device 36 is disposed in a second collecting transport unit 37 (FIG. 4) that extends so as to project into the container attachment unit 14 in the housing 10 from the second cleaning device 36. The second collecting transport unit 37 has an end portion projecting into the container attachment unit 14 and having a discharge hole and an openable lid (not illustrated) on the lower surface thereof.

The second collection container 65, which is a container having a certain shape, includes a connecting portion having a collecting hole in an upper section thereof. The second collecting transport unit 37 is inserted in and connected to the connecting portion.

The second collecting transport unit 37 is inserted in and connected to the connecting portion of the second collection container 65 when the second collection container 65 is attached to the container attachment unit 14.

When the image forming devices 20 and the intermediate transfer device 30 are in operation, unnecessary substances including toners that are collected by the second cleaning device 36 are transported through the second collecting transport unit 37 and received by the second collection container 65.

As illustrated in FIG. 5, the visual image forming apparatus 1 includes a detector 19 that detects the amounts of substances including toners contained in the first collection containers 61 (Y, M, C, and K) and the second collection container 65.

The detector 19 may include sensors that actually measure the amounts of substances including toners contained in the containers. However, to reduce the number of components and cost, for example, the detector 19 may perform estimation based on information items related to the amounts of contents. The information items related to the amounts of contents may be, for example, information regarding the numbers of pixels and densities of the toner images formed on the photoconductors 21 or information regarding the number of paper sheets 9 on which images are formed.

The detector 19 that performs estimation may be configured as a function of the control device 16. In such a case, the detector 19 estimates the amounts of substances including toners contained in the first collection containers 61 (Y, M, C, and K) and the second collection container 65 in advance based on the information items related to the amounts of contents.

The visual image forming apparatus 1 is structured such that the control device 16 determines whether or not the amount of contents of each of the first collection containers 61 (Y, M, C, and K) and the second collection container 65 has reached a nearly full amount that requires replacement based on the amounts of contents that are the detection information obtained by the detector 19. When the predetermined amount of contents that requires replacement is reached, a warning, such as a display, is presented to show that replacement is required.

Structures Involving Waste Toner Images

The visual image forming apparatus 1 is configured to form waste toner images, which are examples of a waste powder image to be discarded (collected) without being transferred to the paper sheet 9.

The waste toner images are, for example, band-shaped toner images or discharge toner images. The band-shaped toner images, which have the shape of a band that extends in a rotational axis direction, are developed by the photoconductors 21 to prevent the occurrence of curling or noise of the contact cleaning members 26*b* of the first cleaning devices 26 for the photoconductors 21. The discharge toner images are formed by electrostatically discharging deteriorated toners contained in the developing devices 24 (Y, M, C, and K) to the photoconductors 21 from the developing rollers 24*b*.

The waste toner images are formed when, for example, low-density toner images are continuously developed on the photoconductors 21 by the developing devices 24 (Y, M, C, and K). The term "low density" means that the pixel density of an image recognized by the image processing device 17 is, for example, less than or equal to 1%. The term "continuously formed" means that, for example, the number of paper sheets 9 on which images are formed is greater than or equal to 100.

The waste toner images may also include, for example, control patch images formed on the photoconductors 21 and transferred to the intermediate transfer belt 31 to obtain information for controlling the image forming operation.

The waste toner images are formed in a period other than periods for forming normal toner images that are to be transferred to the paper sheets 9. The period other than the periods for forming normal toner images includes, for example, a period corresponding to the interval between an image to be formed on one side of one paper sheet 9 and an image to be formed on one side of the next paper sheet 9. The waste toner images are not necessarily formed by all of the four image forming devices 20 (Y, M, C, and K) at the same time, and may instead be formed by one or more of the image forming devices 20 (Y, M, C, and K).

As illustrated in FIG. 5, the visual image forming apparatus 1 includes a determination unit 5 that determines the period for forming the waste toner images. The determination unit 5 collects information including the area coverage, the number of sheets on which images are to be formed, etc. from, for example, the image processing device 17, and determines the period for forming the waste toner images. The determination unit 5 also has a function of counting the number of periods for forming the waste toner images.

The waste toner images are collected by the first cleaning devices 26 for the photoconductors 21 and the second cleaning device 36 for the intermediate transfer belt 31 at a predetermined ratio, and then received by the first collection containers 61 (Y, M, C, and K) and the second collection container 65 at the predetermined ratio. When the waste toner images are formed, no second-transfer-process current is supplied to the second transfer roller of the second transfer device 35, so that the toners on the intermediate transfer belt 31 are not transferred to the second transfer device 35.

The ratio at which the waste toner images are collected by the first cleaning devices 26 and the second cleaning device 36, that is, the ratio at which the waste toner images are received by the first collection containers 61 (Y, M, C, and K) and the second collection container 65, is adjusted by adjusting, for example, the setting of first-transfer-process currents to be supplied to the first transfer rollers of the first transfer devices 25 by the feeding device 18. In particular, the waste toner images include significantly greater amounts of toners than toner images that constitute normal images, and almost 100% of the toners are discarded. Therefore, the amounts of toners to be collected and received need to be taken into consideration.

As illustrated in FIG. 5, the visual image forming apparatus 1 includes a changing unit 6 that changes first-transfer-process currents I(Y), I(M), I(C), and I(K), which are examples of transfer-process biases supplied to the first transfer rollers of the first transfer devices 25 by the feeding device 18 when the waste toner images are formed on the photoconductors 21 of the four image forming devices 20 (Y, M, C, and K). The first-transfer-process currents I(Y), I(M), I(C), and I(K) are changed to adjust the amounts received by the first collection containers 61 (Y, M, C, and K) and the second collection container 65.

The changing unit 6 changes the first-transfer-process currents I (Y, M, C, and K), which are supplied by the feeding device 18 when the waste toner images are formed, based on predetermined detection information at least once before one of the first collection containers 61 (Y, M, C, and K) and the second collection container 65 becomes full (or nearly full) and requires replacement.

The changing unit 6 may be configured as a dedicated independent control device including an arithmetic processing device, a storage element, a storage device, and an input/output device. However, as illustrated in FIG. 5, the changing unit 6 herein is configured as a control function unit of the control device 16 that controls the overall operation of the visual image forming apparatus 1.

The visual image forming apparatus 1 includes the second collection container 65 that is dedicated to receive the substances including toners collected by the second cleaning device 36. Accordingly, referring to FIG. 6A, the changing unit 6 according to the first exemplary embodiment is configured to change the first-transfer-process currents I (Y, M, C, and K), which are supplied when the waste toner images are formed, at least from a first transfer current to a second transfer current. The first transfer current is an example of a first transfer bias set to facilitate transfer of toners in the toner images to the intermediate transfer belt 31. The second transfer current is an example of a second transfer bias set to reduce transfer of the toners in the toner images to the intermediate transfer belt 31.

Assuming that the toners are charged to a negative polarity when used, the first transfer current is set to first-transfer-process currents having a positive polarity ($+\alpha$), similarly to the first-transfer-process currents supplied to transfer normal toner images in the first transfer process. The current value $\alpha$ may be substantially equal to the value of the first-transfer-process currents supplied to transfer normal toner images.

When the first transfer current is supplied, the toners in the waste toner images formed on the photoconductors 21 are easily transferred to the intermediate transfer belt 31. In this case, the second cleaning device 36 collects larger amounts of toners in the waste toner images than the first cleaning devices 26. As a result, the second collection container 65 receives larger amounts of substances including toners than the first collection containers 61 (Y, M, C, and K).

Assuming that the toners are charged to a negative polarity when used as described above, the second transfer current is set to, for example, a current supplied when current supply (output) is OFF (0: zero). The second transfer current may instead be set to a current of a negative polarity. When the second transfer current is set to a current of a negative polarity, for the purpose of, for example, ensuring uniform charging of the photoconductors 21, the image forming devices 20 may include charge eliminating devices that remove charges from the outer peripheral surfaces of the photoconductors 21 after the first transfer process and before the next charging step.

When the second transfer current is supplied, the toners in the waste toner images formed on the photoconductor 21 are not easily transferred to the intermediate transfer belt 31, and tend to remain on the photoconductors 21. In this case, the first cleaning devices 26 collect larger amounts of toners in the waste toner images than the second cleaning device 36. As a result, the first collection containers 61 (Y, M, C, and K) receive larger amounts of substances including toners than the second collection container 65.

The changing unit 6 changes the first-transfer-process currents in accordance with the amounts of toners used to form the waste toner images.

More specifically, in a period or stage in which small amounts of toners are used, first-transfer-process currents that facilitate transfer of the toners in the waste toner images to the intermediate transfer belt 31 are supplied. In a period or stage in which large amounts of toners are used, first-transfer-process currents that reduce transfer of the toners in the waste toner images to the intermediate transfer belt 31 are supplied.

The changing unit 6 of the first exemplary embodiment is configured to change the above-described first-transfer-process currents when the number of times the waste toner images are formed reaches a predetermined number. The first-transfer-process currents are changed at least from the first transfer current to the second transfer current.

The predetermined number may be set based on, for example, the ratio of the capacity of the first collection containers 61 (Y, M, C, and K) to the capacity of the second collection container 65. More specifically, when the ratio of the capacity of the first collection containers 61 (Y, M, C, and K) to the capacity of the second collection container 65 is 1:N (>1), the predetermined number may be set to (N+1). When the actual ratio N is a decimal number, the predetermined number is set to the integer part of the decimal number (number obtained by truncating the fractional part).

In this case, the changing unit 6 receives information regarding the number of times the waste toner images are formed from the above-described determination unit 5.

An operation performed when the waste toner images are formed will now be described.

Figure 7:
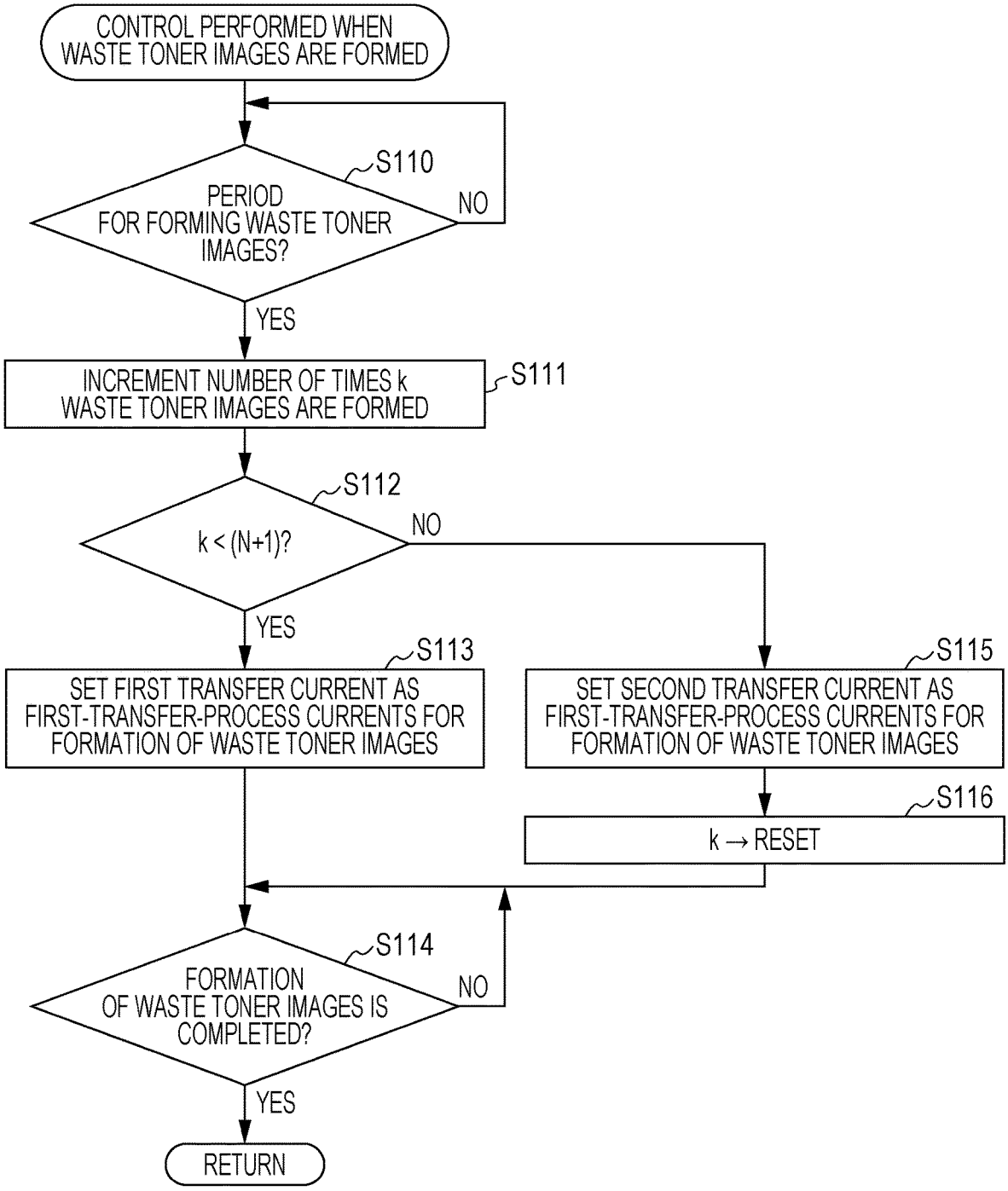
FIG. 7 is a flowchart of an operation performed by the changing unit of the visual image forming apparatus illustrated in FIGS. 1A and 1B.

Referring to FIGS. 5 and 7, the determination unit 5 of the visual image forming apparatus 1 determines whether it is a period for forming waste toner images (Step 110: S110).

When it is determined by the determination unit 5 that it is a period for forming waste toner images, the determination unit 5 increments (+1) the number of times k the waste toner images are formed (S111).

Subsequently, the changing unit 6 determines whether the number of times k the waste toner images are formed is less than the predetermined number (N+1) (S112).

When it is determined that the number of times k is less than the predetermined number (N+1), the changing unit 6 selects the first transfer current as the first-transfer-process currents I (Y, M, C, and K) to be supplied to the first transfer rollers of the first transfer devices 25 by the feeding device 18 when the waste toner images are formed (S113).

In this case, large portions of the waste toner images formed on the photoconductors 21 of the image forming devices 20 (Y, M, C, and K) are transferred to the intermediate transfer belt 31 in the first transfer process at the first transfer positions TP1, at which the first transfer current is supplied. The waste toner images hardly remain on the photoconductors 21.

As a result, large portions of the toners in the waste toner images are collected by the second cleaning device 36 for the intermediate transfer belt 31, and then transported to and received by the second collection container 65. The toners that remain on the photoconductors 21 after the first transfer process are collected by the first cleaning devices 26, and then transported to and received by the first collection containers 61 (Y, M, C, and K).

In addition, in this case, it is determined whether the operation of forming the waste toner images is completed (S114). When it is determined that the operation is completed, the control operation performed when the waste toner images are formed is repeated.

When it is determined that the number of times k is greater than or equal to the predetermined number (N+1) in step S112, the changing unit 6 selects the second transfer current as the first-transfer-process currents I (Y, M, C, and K) to be supplied to the first transfer rollers of the first transfer devices 25 by the feeding device 18 when the waste toner images are formed (S115). In addition, in this case, the determination unit 5 resets the number of times k the waste toner images are formed (S116).

In this case, when the waste toner images are formed on the photoconductors 21 of the image forming devices 20 (Y, M, C, and K), the amount of toners in the waste toner images that are transferred to the intermediate transfer belt 31 in the first transfer process at the first transfer positions TP1, at which the second transfer current is supplied, is less than when the first transfer current is supplied. Accordingly, the amounts of toners that remain on the photoconductors 21 instead of being transferred in the first transfer process are increased. As a result, large amounts of toners in the waste toner images are collected by the first cleaning devices 26 for the photoconductors 21 and then received by the first collection containers 61 (Y, M, C, and K), and the amount of toners collected by the second cleaning device 36 for the intermediate transfer belt 31 and then transferred to and received by the second collection container 65 is reduced.

Also in this case, it is determined whether the operation of forming the waste toner images is completed (S114). When it is determined that the operation is completed, the control operation performed when the waste toner images are formed is repeated.

Here, assume that, for example, the ratio of the capacity of the first collection container 61K for black, which is one of the first collection containers 61 (Y, M, C, and K), to the capacity of the second collection container 65 is 1:3 (=N). In addition, assume that the first collection container 61K for black, which is one of the first collection containers 61 (Y, M, C, and K), has a capacity greater than those of the other first collection containers 61 (Y, M, and C).

Based on the above assumptions, as illustrated in FIG. 6B, the changing unit 6 may set the first transfer current (+α) to such that among the toners in the waste toner images formed by the image forming devices 20 (Y, M, and C), about 10% are received by the first collection containers 61 (Y, M, and C) and about 90% are received by the second collection container 65. In addition, as illustrated in FIG. 6B, the first transfer current (+α) may be set such that among the toner included in the waste toner image formed by the image forming device 20K, about 20% is received by the first collection container 61K and about 80% is received by the second collection container 65.

In addition, based on the above assumptions, as illustrated in FIG. 6B, the changing unit 6 may set the second transfer current to zero (output OFF) so that, among the toners in the waste toner images formed by the image forming devices 20 (Y, M, C, and K), about 30% is received by the first collection containers 61 (Y, M, C, and K) and about 70% is received by the second collection container 65.

Based on the above assumptions, the changing unit 6 changes the first-transfer-process currents from the first transfer current to the second transfer current when the number of times k the waste toner images are formed is four (=N+1).

Thus, the visual image forming apparatus 1 is structured such that the changing unit 6 performs the control operation of changing the first-transfer-process currents supplied when the waste toner images are formed. Accordingly, the ratio between the amounts of toners in the waste toner images received by the first collection containers 61 (Y, M, C, and K) and the second collection container 65 is changed. As a result, the time of replacement of at least one of the first collection containers 61 (Y, M, C, and K) and the second collection container 65 is adjusted.

When the changing unit 6 changes the first-transfer-process currents from the first transfer current to the second transfer current as in the above-described example, the ratio of the amount of toners in the waste toner images that are received by the second collection container 65 is reduced during the operation. Therefore, the time of replacement of the second collection container 65 may be delayed compared to when the first-transfer-process currents are not changed. In other words, in this case, the times of replacement of the first collection containers 61 (Y, M, C, and K) are somewhat advanced compared to when the first-transfer-process currents are not changed.

For reference, when only the first transfer current set by the above-described changing unit 6 is used and is not changed to the second transfer current, the ratio between the amounts of toners in the waste toner images received by the first collection containers 61 (Y, M, C, and K) and the second collection container 65 is not changed. Therefore, the times of replacement of the first collection containers 61 (Y, M, C, and K) and the second collection container 65 are not adjusted. In this case, since the ratio of the amount received by the second collection container 65 is continuously high, the time of replacement of the second collection container 65 is earlier than when the above-described change (change from the first transfer current to the second transfer current) occurs.

Modification of First Exemplary Embodiment

Figure 9:
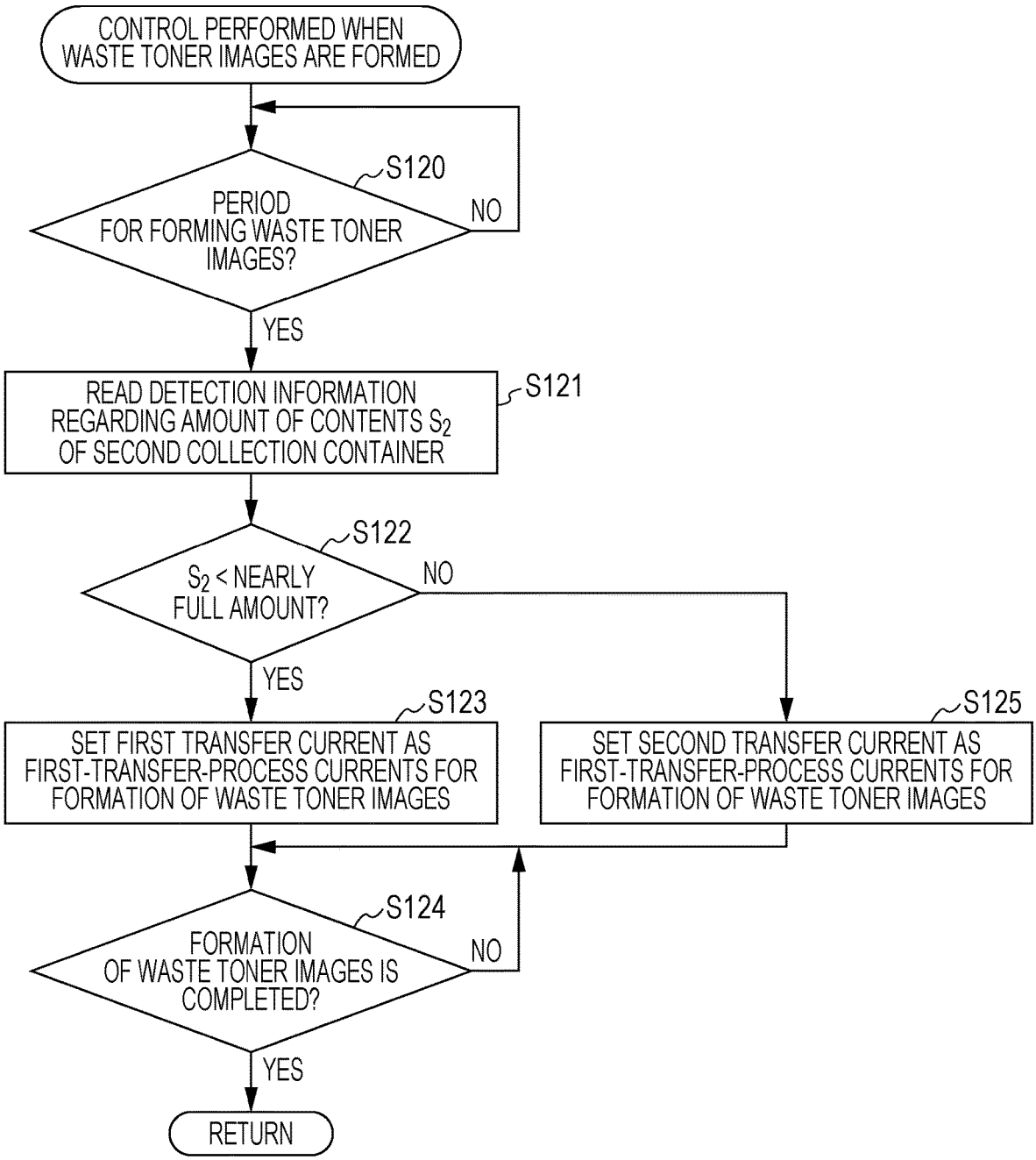
FIG. 9 is a flowchart of an operation performed by the changing unit of the visual image forming apparatus illustrated in FIGS. 8A and 8B.

The changing unit 6 of the visual image forming apparatus 1 according to the first exemplary embodiment may instead make changes illustrated in FIGS. 8A, 8B, and 9.

In this modification, the changing unit 6 changes the first-transfer-process currents when the detector 19, which detects the amounts of substances including toners contained in the first collection containers 61 (Y, M, C, and K) and the second collection container 65, detects a predetermined nearly full amount, which indicates a nearly full state. The nearly full amount may be set to any amount, and may be, for example, 80% of the full amount.

The changing unit 6 according to the modification illustrated in FIGS. 8A, 8B, and 9 is structured based on the assumption that the first collection container 61K of the image forming device 20K, which is one of the four image forming devices 20, has a capacity greater than the capacities of the first collection containers 61 (Y, M, and C) of the other image forming devices 20 (Y, M, and C). The one of the four image forming devices 20 may instead be one of the image forming devices 20 (Y, M, and C) other than the image forming device 20K.

The changing unit 6 according to this modification changes the first-transfer-process currents I (Y, M, C, and K) from the first transfer current to the second transfer current when the predetermined nearly full amount, which indicates a nearly full state, is detected by the detector 19. The second transfer current is set to zero (output OFF), at which no current is supplied to the first transfer devices 25 (FIG. 8A).

An operation performed when the waste toner images are formed by the visual image forming apparatus 1 including the changing unit 6 according to this modification will now be described.

Referring to FIG. 9, the determination unit 5 of the visual image forming apparatus 1 determines whether it is a period for forming waste toner images (S120).

When it is determined by the determination unit 5 that it is a period for forming waste toner images, the changing unit 6 receives detection information regarding an amount of contents S2 of the second collection container 65 from the detector 19 (S121).

Subsequently, the changing unit 6 determines whether the amount of contents S2 of the second collection container 65 is less than the nearly full amount (S122).

When it is determined that the amount of contents S2 of the second collection container 65 is less than the nearly full amount, the changing unit 6 selects the first transfer current as the first-transfer-process currents I (Y, M, C, and K) to be supplied to the first transfer rollers of the first transfer devices 25 by the feeding device 18 when the waste toner images are formed (S123).

In this case, large portions of the waste toner images formed on the photoconductors 21 of the image forming devices 20 (Y, M, C, and K) are transferred to the intermediate transfer belt 31 in the first transfer process at the first transfer positions TP1, at which the first transfer current is supplied. The waste toner images hardly remain on the photoconductors 21. As a result, large portions of the toners in the waste toner images are collected by the second cleaning device 36 for the intermediate transfer belt 31, and then transported to and received by the second collection container 65. The toners that remain on the photoconductors 21 instead of being transferred to the intermediate transfer belt 31 in the first transfer process are collected by the first cleaning devices 26, and then transported to and received by the first collection containers 61 (Y, M, C, and K).

In addition, in this case, it is determined whether the operation of forming the waste toner images is completed (S124). When it is determined that the operation is completed, the control operation performed when the waste toner images are formed is repeated.

When it is determined in Step 122 (S122) that the amount of contents S2 of the second collection container 65 is greater than or equal to the nearly full amount, the changing unit 6 selects the second transfer current as the first-transfer-process currents I (Y, M, C, and K) to be supplied to the first transfer rollers of the first transfer devices 25 by the feeding device 18 when the waste toner images are formed (S125). In this case, as illustrated in FIG. 8A, the second transfer current is set to zero, at which no current is supplied, for each of the first-transfer-process currents I (Y, M, C, and K).

In this case, when the waste toner images are formed on the photoconductors 21 of the image forming devices 20 (Y, M, C, and K), the amount of toners in the waste toner images that are transferred to the intermediate transfer belt 31 in the first transfer process at the first transfer positions TP1, at which the second transfer current is supplied, is less than when the first transfer current is supplied. As a result, the amount of toners in the waste toner images that are transferred to the intermediate transfer belt 31 in the first transfer process, collected by the second cleaning device 36, and then received by the second collection container 65 is reduced. In contrast, the amounts of toners in the waste toner images that are collected by the first cleaning devices 26 of the image forming devices 20 (Y, M, C, and K) are greater than when the first transfer current is supplied, and larger amounts of collected toners are received by the corresponding first collection containers 61 (Y, M, C, and K).

Also in this case, it is determined whether the operation of forming the waste toner images is completed (S124). When it is determined that the operation is completed, the control operation performed when the waste toner images are formed is repeated.

After this, it is continuously determined that the amount of contents S2 of the second collection container 65 is greater than or equal to the nearly full amount in step 122. Therefore, the changing unit 6 continuously selects the second transfer current. Accordingly, this control operation is continued until the amount of contents of one of the first collection containers 61 (Y, M, C, and K) reaches the full amount or nearly full amount.

Here, assume that, for example, the ratio of the capacity of the first collection container 61K for black, which is one of the first collection containers 61 (Y, M, C, and K), to the capacity of the second collection container 65 is, for example, 1:3 (=N), and that the first collection container 61K for black, which is one of the first collection containers 61 (Y, M, C, and K), has a capacity greater than those of the other first collection containers 61 (Y, M, and C) by a factor of, for example, 1.5.

Based on the above assumptions, as illustrated in FIG. 8B, the changing unit 6 according to the modification may set the first transfer current (+α) such that among the toners in the waste toner images formed by the image forming devices 20 (Y, M, and C), about 10% are received by the first collection containers 61 (Y, M, and C) and about 90% are received by the second collection container 65. In addition, as illustrated in FIG. 8B, the first transfer current (+α) to be supplied to the first transfer device 25 of the image forming device 20K may be set such that among the toner included in the waste toner image formed by the image forming device 20K, about 20% is received by the first collection container 61K and about 80% is received by the second collection container 65. Thus, the second collection container 65 receives the largest amount of toners in the waste toner images.

In addition, based on the above assumptions, as illustrated in FIG. 8B, the changing unit 6 according to the modification may set the second transfer current (output OFF) so that the amount of toners received by the second collection container 65, which is nearly full, is reduced to about 70% and that the first collection containers 61 (Y, M, C, and K) receive about 30% of the toners in the waste toner images formed by the image forming devices 20 (Y, M, C, and K).

Thus, the visual image forming apparatus 1 including the changing unit 6 according to the modification is also structured such that the changing unit 6 performs the control operation of changing the first-transfer-process currents supplied when the waste toner images are formed. Accordingly, the ratio between the amounts of toners in the waste toner images received by the first collection containers 61 (Y, M, C, and K) and the second collection container 65 is changed. As a result, the time of replacement of at least one of the first collection containers 61 (Y, M, C, and K) and the second collection container 65 is adjusted. In particular, in this case, the time of replacement of at least one of the second collection container 65 and the first collection containers 61 (Y, M, C, and K) (in practice, the time or replacement of the first collection containers 61 (Y, M, C, and K)) may be efficiently adjusted by utilizing the second collection container 65 having the largest capacity and the first collection container 61K having a relatively large capacity among the first collection containers 61 (Y, M, C, and K).

In the first exemplary embodiment, the changing unit 6 may change the first-transfer-process currents based on information of estimated amounts of toners used to form the waste toner images instead of changing the first-transfer-process currents when the number of times the waste toner images are formed reaches the predetermined number.

The changing unit 6 of the above-described modification may set the second transfer current so that the toners are reversely transferred to the photoconductor 21 of the image forming device 20K. In such a case, assuming that the toners are charge to a negative polarity when used, the second transfer current may be set to a current of a negative polarity.

When the second transfer current is set as described above, for example, a large portion of the waste toner on the photoconductor 21 of the image forming device 20K may be collected by the first cleaning device 26. In addition, portions of the waste toners on the photoconductors 21 of the remaining image forming devices 20 (Y, M, and C) that have been transferred to the intermediate transfer belt 31 in the first transfer process may be reversely transferred to the photoconductor 21 of the image forming device 20K, which is disposed downstream of the remaining image forming devices 20 (Y, M, and C) in the transporting direction of the intermediate transfer belt 31 (rotation direction B), and collected by the first cleaning device 26 for the photoconductor 21.

The changing unit 6 of the above-described modification may instead be configured such that, after the amount of contents S2 of the second collection container 65 reaches the nearly full amount, the first-transfer-process currents are changed to the second transfer current, which is zero or a current of a negative polarity, only for the first transfer devices 25 of one or more of the image forming devices 20 (Y, M, C, and K) including one or more of the first collection containers 61 (Y, M, C, and K) whose contents are less than the nearly full amount.

When the above-described structure is employed, the time of replacement of at least one of the second collection container 65 and the first collection containers 61 (Y, M, C, and K) (in practice, at least one of the first collection containers 61 (Y, M, C, and K)) may be efficiently adjusted by effectively utilizing the first collection containers 61 with large remaining capacities.

Second Exemplary Embodiment

Figure 10:
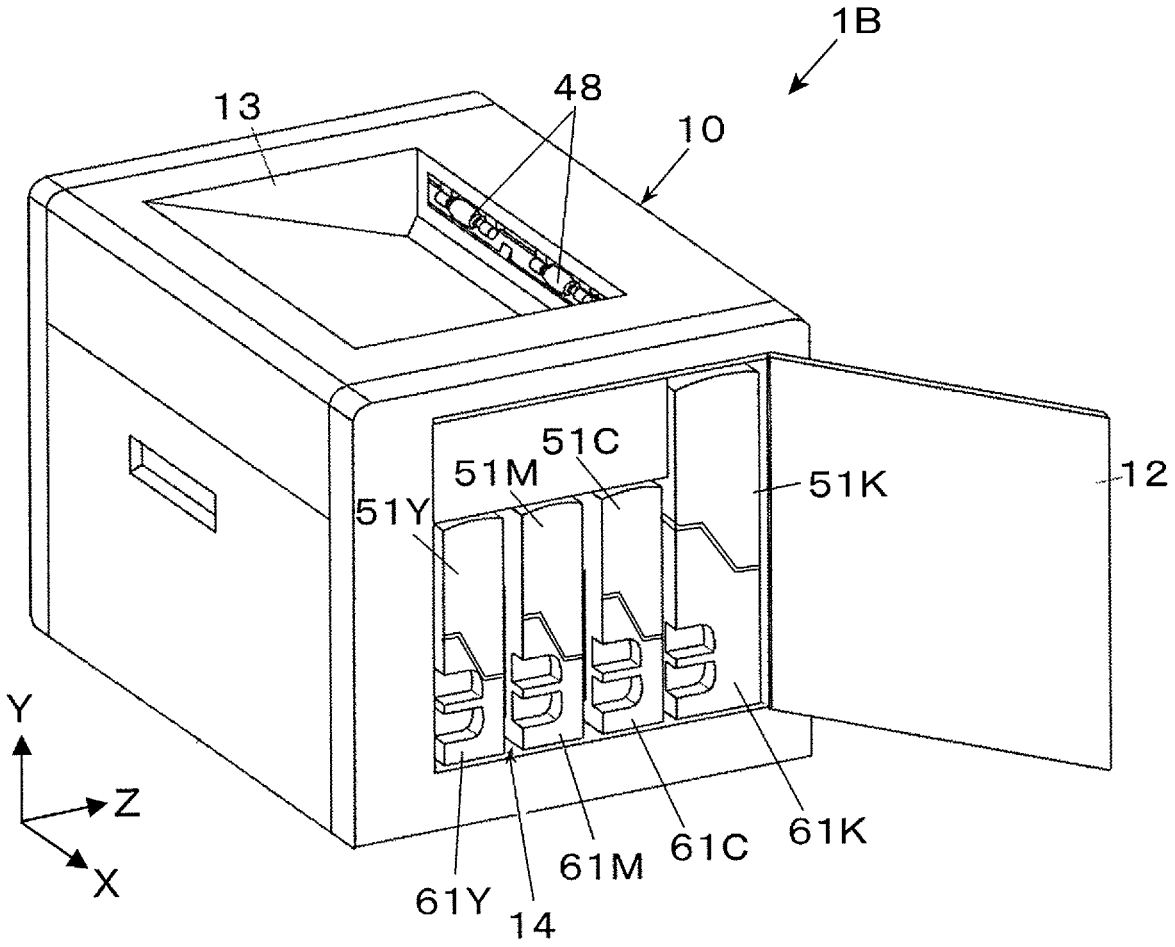
FIG. 10 is a perspective view of a visual image forming apparatus according to a second exemplary embodiment in a state in which a side covering is opened.
Figure 11:
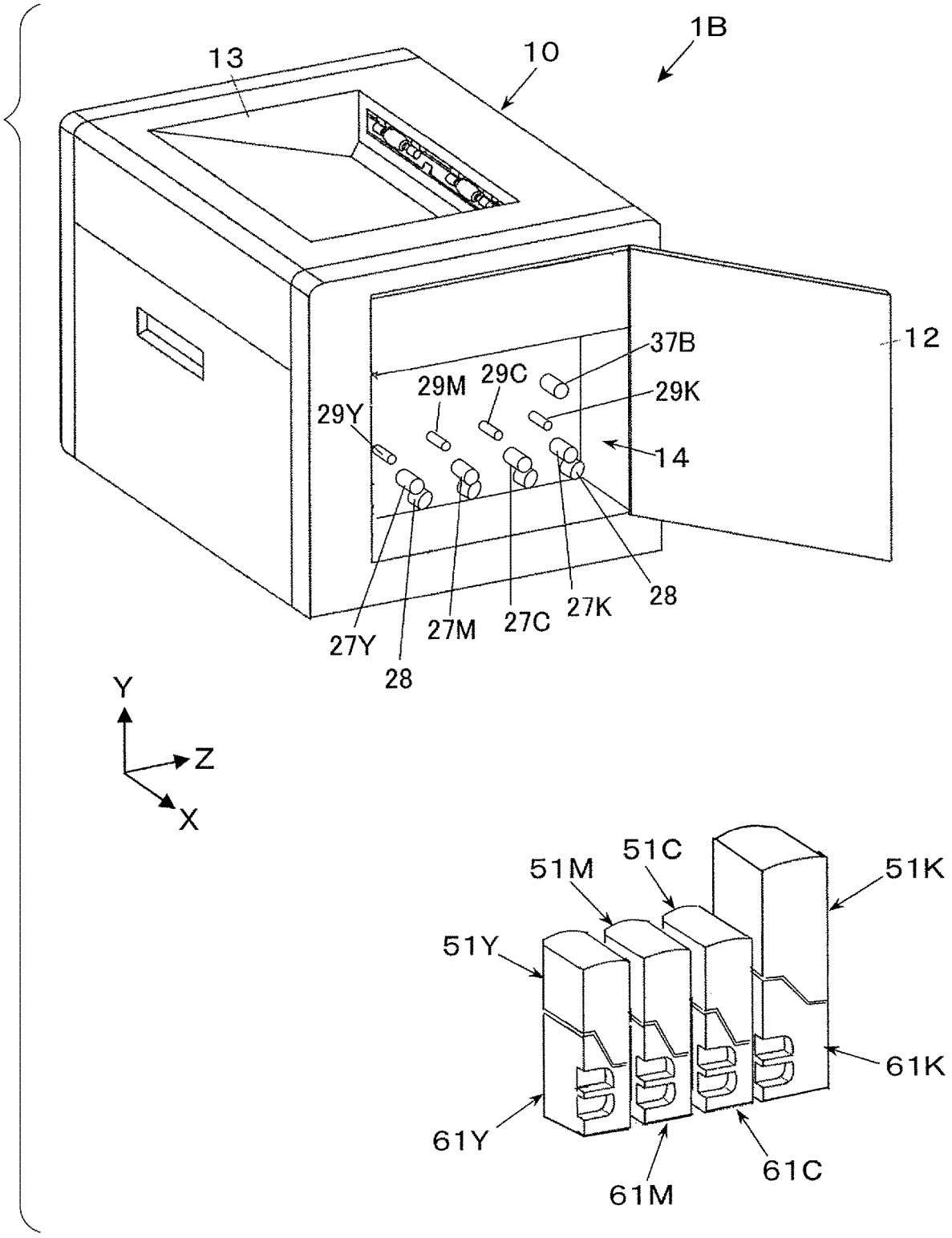
FIG. 11 is a perspective view of the visual image forming apparatus illustrated in FIG. 10 in a state in which removable containers are removed.

FIGS. 10 and 11 illustrate a visual image forming apparatus 1B according to a second exemplary embodiment as another example of an image forming apparatus.

The visual image forming apparatus 1B according to the second exemplary embodiment has the same structure as that of the visual image forming apparatus 1 according to the first exemplary embodiment except that the visual image forming apparatus 1B does not include the second collection container 65 for receiving unnecessary substances, such as toners, collected by the second cleaning device 36 for the intermediate transfer belt 31 and includes a changing unit 6B that makes changes different from those made by the changing unit 6 according to the first exemplary embodiment.

Figure 12:
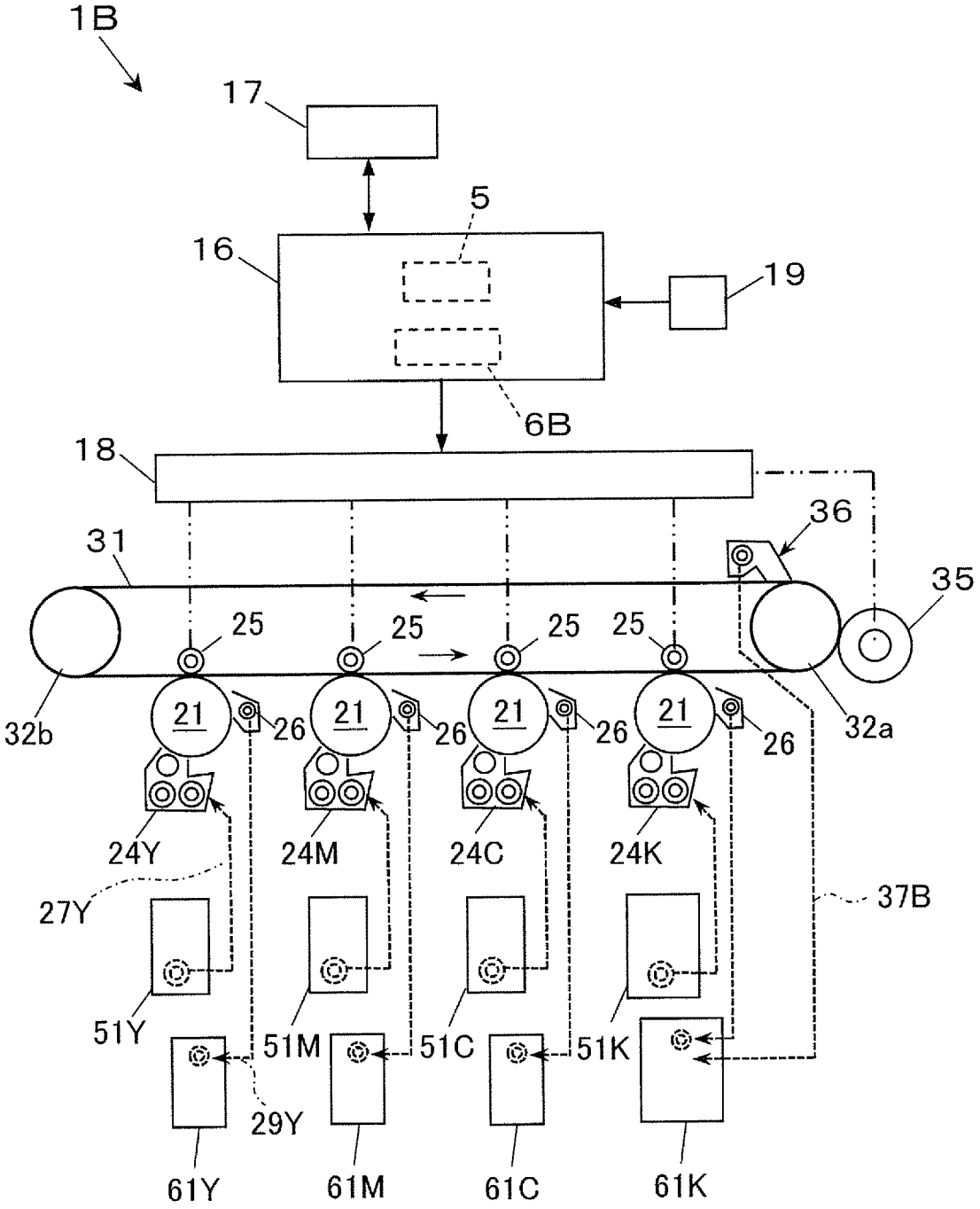
FIG. 12 is a schematic diagram illustrating the structure related to a changing unit included in the visual image forming apparatus illustrated in FIG. 10.

As illustrated in FIGS. 10 and 11, the visual image forming apparatus 1B does not include the second collection container 65 (FIGS. 4 and 5) for receiving unnecessary substances, such as toners, collected by the second cleaning device 36. Instead, as illustrated in FIGS. 11 and 12, the visual image forming apparatus 1B is structured such that, among the first collection containers 61 (Y, M, C, and K) of the image forming devices 20 (Y, M, C, and K), the first collection container 61K for black of the image forming device 20K has a capacity greater than those of the other first collection containers 61 (Y, M, and C) of the remaining image forming devices 20 (Y, M, and C). The first collection container 61K for black is configured to receive the unnecessary substances, such as toners, collected by the second cleaning device 36.

In accordance with the above-described structure, as illustrated in FIG. 12, the visual image forming apparatus 1B includes a second collecting transport unit 37B that serves as the collecting transport unit 37 for transporting the unnecessary substances, such as toners, collected by the second cleaning device 36. The position, shape, etc. of the second collecting transport unit 37B are such that the second collecting transport unit 37B is connectable to a connecting portion of the first collection container 61K for black.

The visual image forming apparatus 1B is structured such that the second collection container 65 dedicated to receive the substances including toners collected by the second cleaning device 36 is not provided, and that the substances including toners are instead received by the first collection container 61K that serves also as a second collection container. Accordingly, as illustrated in FIG. 13A, the changing unit 6B of the second exemplary embodiment is configured to change the first-transfer-process currents at least from a first transfer current to a second transfer current. The first transfer current is set to reduce transfer of the toners in the waste toner images to the intermediate transfer belt 31. The second transfer current is set to cause the toners in the waste toner images to be reversely transferred to the photoconductor 21 of at least one of the remaining image forming devices 20 (Y, M, and C). The at least one of the remaining image forming devices 20 (Y, M, and C) is, for example, the image forming device 20 provided with the first collection container 61 having a relatively large remaining capacity.

Assuming that the toners are charged to a negative polarity when used, as illustrated in FIG. 13A, the first transfer current is set to first-transfer-process currents having a positive polarity (+β), similarly to the first-transfer-process currents supplied to transfer normal toner images in the first transfer process. The current value β is less than the value of the first-transfer-process currents supplied to transfer normal toner images. In other words, the current value β is set to a value less than the current value α of the first transfer current in the first exemplary embodiment (β<α), so that the toners on the photoconductor 21 are not easily transferred to the intermediate transfer belt 31 in the first transfer process. The value of +β may be the same as the above-described current value α. The value of −β is set to a value different from the above-described current value α.

When the first transfer current is supplied, the toners in the waste toner images formed on the photoconductors 21 are not easily transferred to the intermediate transfer belt 31. In this case, the first cleaning devices 26 collect larger amounts of toners in the waste toner images than the second cleaning device 36. As a result, the first collection containers 61 (Y, M, C, and K) receive the respective collected substances including toners, and the first collection container 61K for black additionally receive the substances including toners collected by the second cleaning device 36.

Assuming that the toners are charged to a negative polarity when used as described above, as illustrated in FIG. 13A, the second transfer current is set such that the toners are reversely transferred only to the photoconductor 21 of the image forming device 20 including the first collection container 61 with the smallest amount of contents $S_1$ among the first collection containers 61 (Y, M, and C) of the remaining image forming devices 20 (Y, M, and C).

In the second exemplary embodiment, assume that, for example, the first collection container 61 with the smallest amount of contents is the first collection container 61Y for yellow. When the second transfer current is set to a current of a negative polarity, for the purpose of, for example, ensuring uniform charging of the photoconductors 21, the image forming devices 20 may include charge eliminating devices that remove charges from the outer peripheral surfaces of the photoconductors 21 after the first transfer process and before the next charging step.

When the second transfer current is selected, the toners in the waste toner images formed on the photoconductors 21 of the image forming devices 20 (M, C, and K) are not easily transferred from the photoconductors 21 to the intermediate transfer belt 31, and tend to remain on the photoconductors 21. In addition, the toners are reversely transferred from the intermediate transfer belt 31 to the photoconductor 21 of the image forming device 20Y for yellow.

In this case, the intermediate transfer belt 31 has toners transferred thereto by the image forming devices 20 (M, C, and K) in the first transfer process. These toners are also reversely transferred to the photoconductor 21 of the image forming device 20Y for yellow. Accordingly, large amounts of toners in the waste toner images are collected by the first cleaning device 26 of the image forming device 20Y for yellow. The toners that have been transferred from the photoconductors 21 of the image forming devices 20 (M, C, and K) for other colors to the intermediate transfer belt 31 in the first transfer process are reversely transferred to the photoconductor 21 of the image forming device 20Y for yellow and collected by the first cleaning device 26 therefor.

As a result, a relatively large amount of collected substances including toners are received by the first collection container 61Y of the image forming device 20Y for yellow.

An operation performed when the waste toner images are formed by the visual image forming apparatus 1 including the changing unit 6B according to the second exemplary embodiment will now be described.

Figure 14:
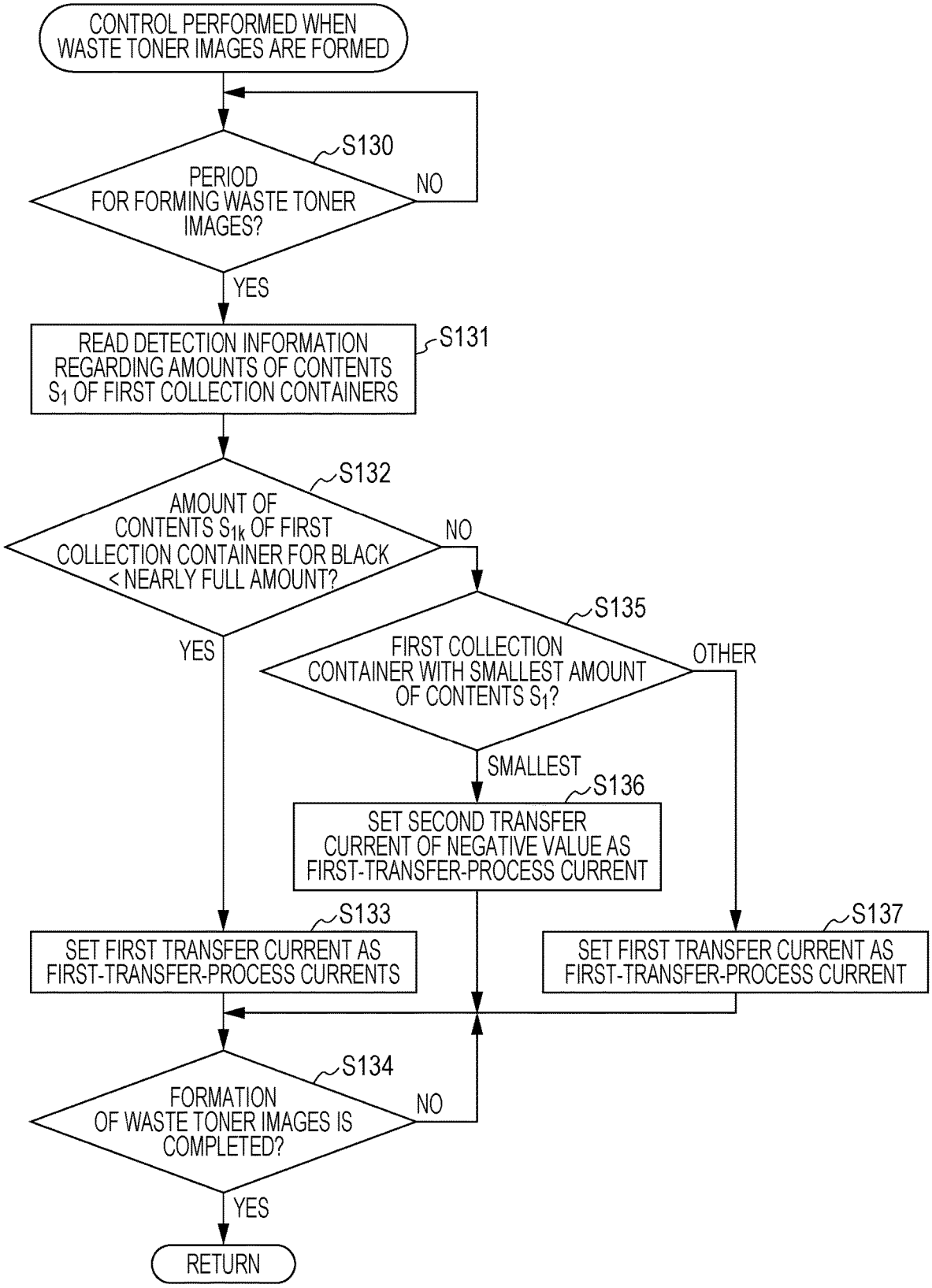
FIG. 14 is a flowchart of an operation performed by the changing unit of the visual image forming apparatus illustrated in FIG. 10.

Referring to FIG. 14, the determination unit 5 of the visual image forming apparatus 1 determines whether it is a period for forming waste toner images (S130).

When it is determined by the determination unit 5 that it is a period for forming waste toner images, the changing unit 6B receives detection information regarding the amount of contents $S_1$ of each of the first collection containers 61 (Y, M, C, and K) from the detector 19 (S131).

Subsequently, the changing unit 6B determines whether an amount of contents $S_{1k}$ of the first collection container 61K for black, which has a relatively large capacity, is less than a nearly full amount (S132).

When it is determined that the amount of contents $S_{1k}$ of the first collection container 61K for black is less than the nearly full amount, the changing unit 6B selects the first transfer current as the first-transfer-process currents I (Y, M, C, and K) to be supplied to the first transfer rollers of the first transfer devices 25 by the feeding device 18 when the waste toner images are formed (S133).

In this case, large portions of the waste toner images formed on the photoconductors 21 of the image forming devices 20 (Y, M, C, and K) remain on the photoconductors 21, and only small amounts of toners are transferred to the intermediate transfer belt 31 in the first transfer process. As a result, large portions of the toners in the waste toner images are collected by the first cleaning devices 26 for the photoconductors 21, and then received by the first collection containers 61 (Y, M, C, and K). The toners that have been transferred to the intermediate transfer belt 31 in the first transfer process are collected by the second cleaning device 36, and then transported to and received by the first collection container 61K for black through the second collecting transport unit 37B.

In addition, in this case, it is determined whether the operation of forming the waste toner images is completed (S134). When it is determined that the operation is completed, the control operation performed when the waste toner images are formed is repeated.

When it is determined in Step 132 (S132) that the amount of contents $S_{1k}$ of the first collection container 61K for black is greater than or equal to the nearly full amount, the changing unit 6B selects the second transfer current as the first-transfer-process currents I (Y, M, C, and K) to be supplied to the first transfer rollers of the first transfer devices 25 by the feeding device 18 when the waste toner images are formed (S135).

The second transfer current is set to −β only for the first-transfer-process current IY supplied to the first transfer device 25 of the image forming device 20Y for yellow. The second transfer current is set to +β, which is the same as the first transfer current, for the first-transfer-process currents supplied to the first transfer devices 25 of the remaining image forming devices 20 (M, C, and K).

In this case, among the waste toner images formed by the image forming devices 20 (Y, M, C, and K), the waste toner images formed by the image forming devices 20 (M, C, and K) tend to remain on the photoconductors 21 and are not easily transferred to the intermediate transfer belt 31 in the first transfer process. In the image forming device 20Y for yellow, reverse transferring from the intermediate transfer belt 31 to the photoconductor 21 occurs. Therefore, the toners on the intermediate transfer belt 31 are reversely transferred to this photoconductor 21, so that the amount of toners on the photoconductor 21 is increased.

As a result, the amount of toners in the waste toner images that are collected by the first cleaning device 26 of the image forming device 20Y for yellow and received by the first collection container 61Y is increased. In addition, the amount of toners that remain on the intermediate transfer belt 31 and are collected by the second cleaning device 36 is reduced, and therefore the amount of toners received by the first collection container 61K for black, which is determined to be nearly full, is less than when the first transfer current is selected.

Also in this case, it is determined whether the operation of forming the waste toner images is completed (S134). When it is determined that the operation is completed, the control operation performed when the waste toner images are formed is repeated.

After this, it is continuously determined that the amount of contents $S_{1k}$ of the first collection container 61K for black is greater than or equal to the nearly full amount in step 132. Therefore, the changing unit 6B continuously selects the second transfer current. Accordingly, this control operation is continued until an amount of contents Sly of the first collection container 61Y for yellow reaches the nearly full amount. Then, the changing unit 6B changes the first-transfer-process current for one of the image forming devices 20M and 20C including one of the first collection containers 61M and 61C for magenta and cyan with the next smallest amount of contents to the second transfer current at which reverse transferring occurs (−β).

In the second exemplary embodiment, as illustrated in FIG. 13B, the changing unit 6B may set the first transfer current such that among the toners in the waste toner images formed by the image forming devices 20 (Y, M, C, and K), about 10% are received by each of the first collection containers 61 (Y, M, and C) and about 70% are received by the first collection container 61K for black because the toners collected by the second cleaning device 36 are also received by the first collection container 61K for black. When the first transfer current is set as described above, the first collection container 61K for black receives the largest amount of toners in the waste toner images.

In addition, in the second exemplary embodiment, as illustrated in FIG. 13B, the changing unit 6B may set the second transfer current such that the amount of toner received by the first collection container 61Y for yellow, for which the amount of contents $S_1$ detected by the detector 19 is the smallest, is increased to about 70%, and that the amount of toner received by the first collection container 61K for black, which is nearly full, is reduced to about 10%.

Thus, the visual image forming apparatus 1B including the changing unit 6B is also structured such that the changing unit 6B performs the control operation of changing the first-transfer-process currents supplied when the waste toner images are formed. Accordingly, the ratio between the amounts of toners in the waste toner images received by the first collection containers 61 (Y, M, C, and K) is changed. As a result, the time of replacement of at least one of the first collection containers 61 (Y, M, C, and K) is efficiently adjusted by utilizing the first collection container 61Y for yellow, which has the smallest amount of toner contained therein.

In particular, in this case, the time of replacement of the first collection container 61K for black, which has the largest capacity, may be somewhat delayed compared to when the changing unit 6B does not change the first-transfer-process currents.

Third Exemplary Embodiment

Figure 15:
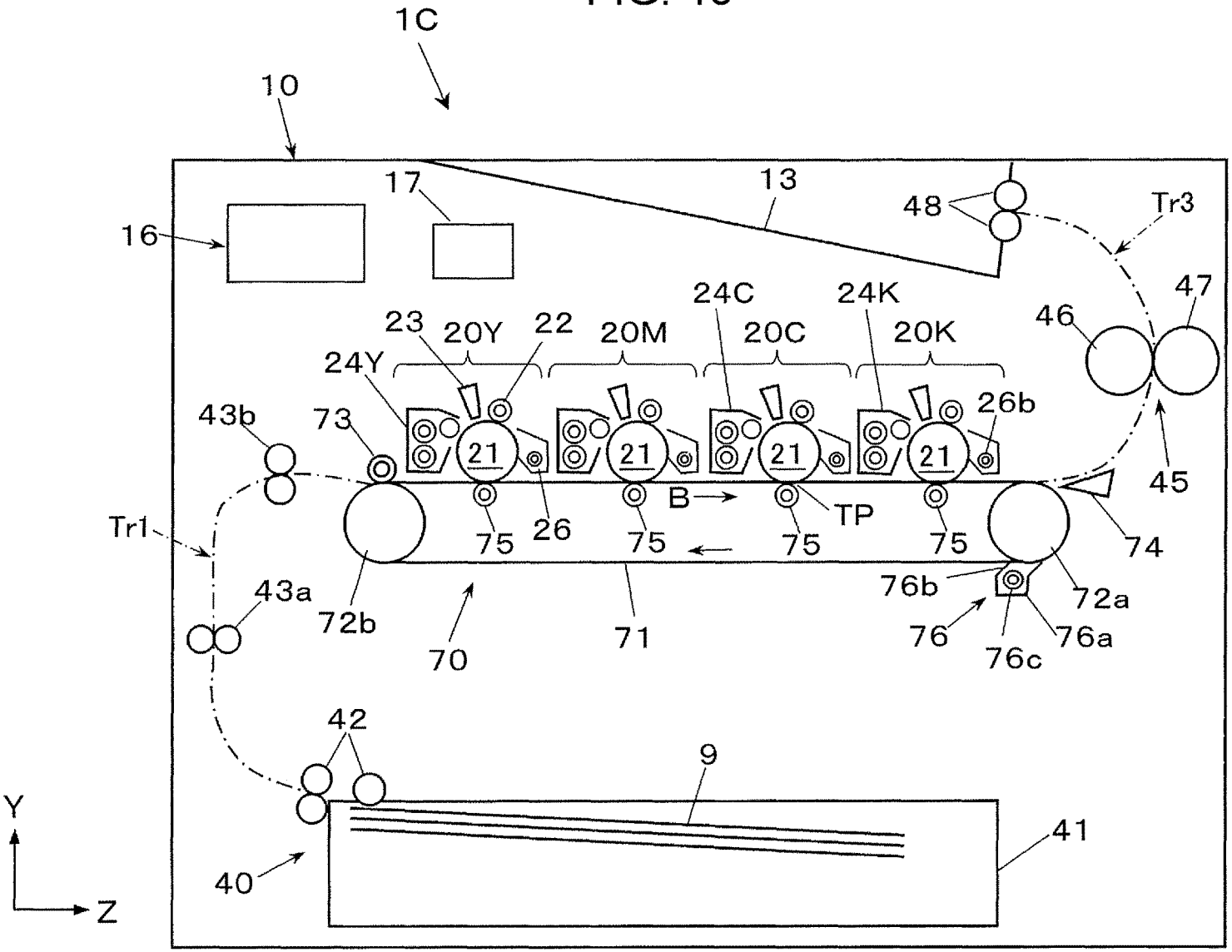
FIG. 15 illustrates the internal structure of a visual image forming apparatus according to a third exemplary embodiment.

FIG. 15 illustrates a visual image forming apparatus 1C according to a third exemplary embodiment as another example of an image forming apparatus.

The visual image forming apparatus 1C according to the third exemplary embodiment has the same structure as that of the visual image forming apparatus 1 according to the first exemplary embodiment except that a direct transfer method, in which toner images are directly transferred onto a paper sheet 9, which is as an example of a sheet-shaped object, is used instead of the intermediate transfer method used by the visual image forming apparatus 1 according to the first exemplary embodiment.

As illustrated in FIG. 15, the visual image forming apparatus 1C includes image forming devices 20, a transferring-and-transporting device 70, a sheet supplying device 40, a fixing device 45, and a control device 16, which are disposed in the space inside a housing 10. The image forming devices 20 form visible images based on image information. The transferring-and-transporting device 70 transports the paper sheet 9 so that toner images, which are examples of the visible images formed by the image forming devices 20, are transferred to the paper sheet 9. The sheet supplying device 40 contains the paper sheet 9 to be supplied to the transferring-and-transporting device 70 and supplies the paper sheet 9. The fixing device 45 fixes the visible images transported and transferred by the transferring-and-transporting device 70 to the paper sheet 9. The control device 16 controls, for example, the operation of each device.

The image forming devices 20, the sheet supplying device 40, the fixing device 45, and the control device 16 included in the visual image forming apparatus 1C have substantially the same structures as those of the image forming devices 20, the sheet supplying device 40, the fixing device 45, and the control device 16 according to the first exemplary embodiment. Components of the above-mentioned devices that are the same as those in the first exemplary embodiment are denoted by the same reference numerals, and description thereof is omitted unless necessary.

As illustrated in FIG. 15, the transferring-and-transporting device 70 of the visual image forming apparatus 1C includes a transferring-and-transporting belt 71, which is an example of a transferring-and-transporting body that transports the paper sheet 9 so that the toner images formed by the image forming devices 20 are transferred onto the paper sheet 9. Devices including a sheet pressing member 73, a sheet separating member 74, transfer devices 75, and a third cleaning device 76 are arranged along the transferring-and-transporting belt 71.

The transferring-and-transporting belt 71 is an endless belt capable of holding the paper sheet 9 by, for example, electrostatic force. Similarly to the intermediate transfer belt 31, the transferring-and-transporting belt 71 is supported by a plurality of support rollers 72 (for example, two support rollers 72*a* and 72*b*) disposed inside the transferring-and-transporting belt 71 so that the transferring-and-transporting belt 71 rotates (circulates) in the direction of arrow B while successively passing through transfer positions TP of the image forming devices 20 (Y, M, C, and K), which will be described below. One of the support rollers 72*a* and 72*b* serves as a driving roller. The toners may also be transferred to the transferring-and-transporting belt 71.

The sheet pressing member 73 is a member that presses the paper sheet 9 transported from and supplied by the sheet supplying device 40 against the outer peripheral surface of the transferring-and-transporting belt 71. The sheet pressing member 73 is in contact with the outer peripheral surface of a portion of the transferring-and-transporting belt 71 that is supported by the support roller 72*b*. The sheet pressing member 73 may be a roller-shaped member that is rotatable in contact with the outer peripheral surface of the transferring-and-transporting belt 71. Two pairs of transport rollers 43*a* and 43*b*, for example, are arranged along the supply transport path Tr1.

The sheet separating member 74 is a member for assisting separation of the paper sheet 9 from the outer peripheral surface of the transferring-and-transporting belt 71, and is disposed near the outer peripheral surface of a portion of the transferring-and-transporting belt 71 that is supported by the support roller 72*a*.

The transfer devices 75 are devices that basically electrostatically transfer the toner images of the respective colors formed on the photoconductors 21 of the image forming devices 20 (Y, M, C, and K) to the paper sheet 9 transported by the transferring-and-transporting belt 71. The transfer devices 75 have substantially the same structure as that of the first transfer devices 25 according to, for example, the first exemplary embodiment. The transfer devices 75 include transfer rollers, which are examples of contact transfer members, disposed inside the transferring-and-transporting belt 71 so that the transfer rollers are rotatable while pressing the transferring-and-transporting belt 71 against the photoconductors 21 of the image forming devices 20 (Y, M, C, and K). The transfer devices 75 constitute portions of the image forming devices 20 (Y, M, C, and K).

The third cleaning device 76 is a device that cleans the outer peripheral surface of the transferring-and-transporting belt 71 by removing unnecessary substances, such as unnecessary toners, that remain on the outer peripheral surface of the transferring-and-transporting belt 71 after the transfer process. The third cleaning device 76 is disposed below the outer peripheral surface of a portion of the transferring-and-transporting belt 71 that is supported by the support roller 72*a*. As illustrated in FIG. 15, the third cleaning device 76 includes a container body 76*a* in which components including a contact cleaning member 76*b* and a transport member 76*c* are disposed. The contact cleaning member 76*b* scrapes off the unnecessary substances including toners. The transport member 76*c* is, for example, a screw auger that collects the unnecessary substances scraped off by the contact cleaning member 76*b* and transports the unnecessary substances to a third collection container 67, which will be described below.

The transferring-and-transporting device 70 has the transfer positions TP at which the photoconductors 21 of the image forming devices 20 (Y, M, C, and K) face the transfer rollers of the respective ones of the transfer devices 75 (with the transferring-and-transporting belt 71 interposed therebetween) and at which the toner images are transferred.

When the control device 16 of the visual image forming apparatus 1C is instructed to carry out image formation by the external connection device connected to the visual image forming apparatus 1C and receives a command for an image forming operation, each of the image forming devices 20 (Y, M, C, and K) forms a toner image of one of the four colors (Y, M, C, and K) on the photoconductor 21 thereof. In addition, the paper sheet 9 supplied from the sheet supplying device 40 along the supply transport path Tr1 is held by the transferring-and-transporting belt 71 of the transferring-and-transporting device 70 with the assistance of the pressing force applied by the sheet pressing member 73, and is transported so as to pass through the transfer positions TP.

Accordingly, the toner images formed on the photoconductors 21 of the image forming devices 20 (Y, M, C, and K) are directly transferred onto the paper sheet 9 held by the transferring-and-transporting belt 71 at the transfer positions TP.

In the image forming operation performed by the visual image forming apparatus 1C, the paper sheet 9 to which the toner images have been transferred at the transfer positions TP is introduced to and passes through the nip portion of the fixing device 45 after being separated from the transferring-and-transporting belt 71 with the assistance of the sheet separating member 74. Thus, the toner images are fixed to the paper sheet 9. Finally, the paper sheet 9 having the toner images fixed thereto is transported along the output transport path Tr3, and is output to and received by the output receiver 13.

Figure 16:
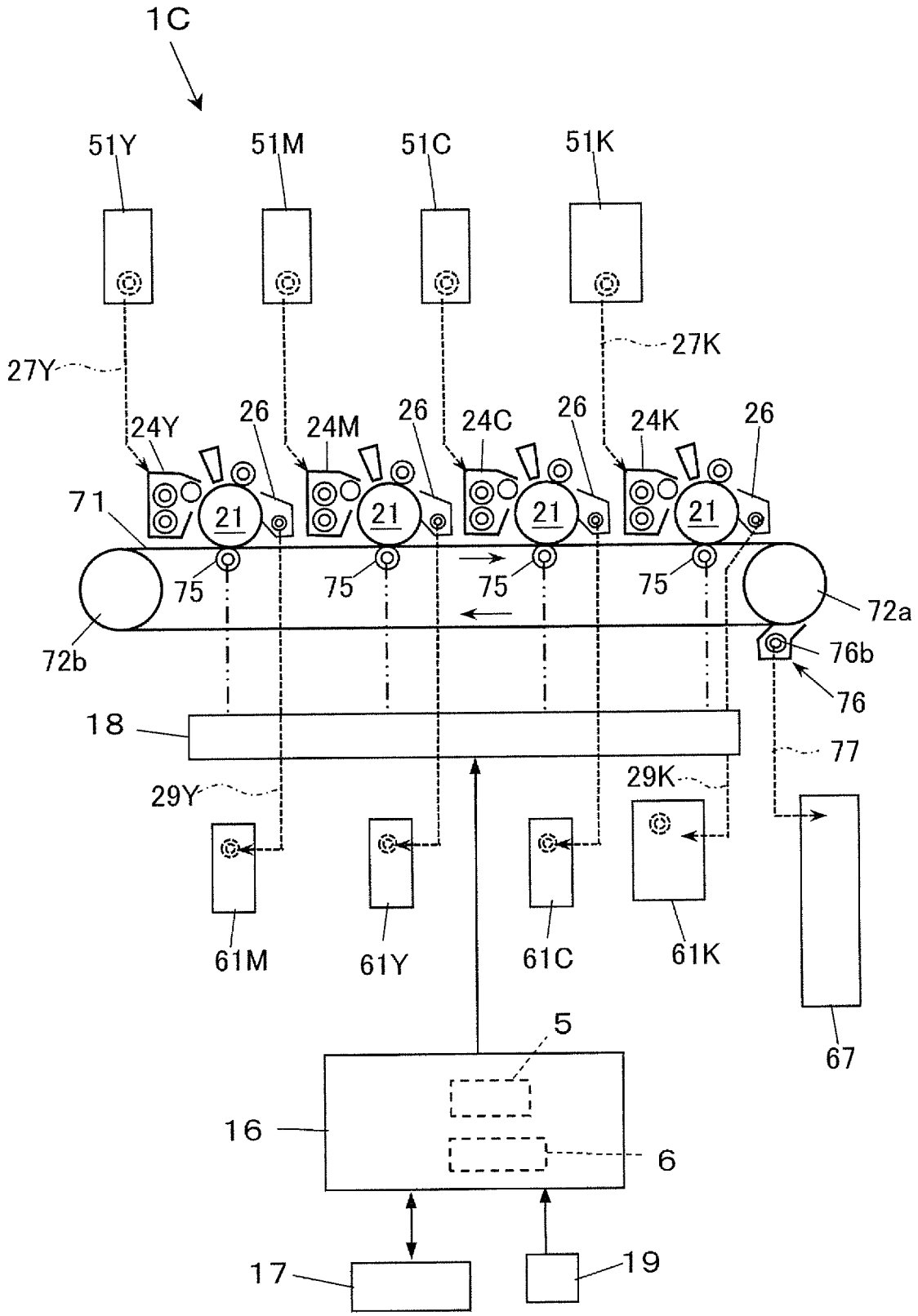
FIG. 16 is a schematic diagram illustrating the structure related to a changing unit included in the visual image forming apparatus illustrated in FIG. 15.

Similar to the visual image forming apparatus 1 according to the first exemplary embodiment, the housing 10 of the visual image forming apparatus 1C has a container attachment unit 14, to which replaceable containers are removably attached, at a location accessible when the side covering 12 is opened (see FIGS. 1B and 4). Referring to FIG. 16, the replaceable containers include developer containers 51Y, 51M, 51C, and 51K, first collection containers 61Y, 61M, 61C, and 61K, and the third collection container 67 that receives developers including toners collected by the third cleaning device 76.

The visual image forming apparatus 1C includes a third collecting transport path 77 along which the developers including toners collected by the third cleaning device 76 are transported to the third collection container 67. The third collecting transport path 77 has an end portion that projects into the container attachment unit 14, and the projecting end portion (connecting portion) is connected to the third collection container 67.

Similar to the visual image forming apparatus 1 according to the first exemplary embodiment, the visual image forming apparatus 1C is also configured to form waste toner images, which are examples of a waste powder image to be discarded (collected) without being transferred onto the paper sheet 9.

As illustrated in FIG. 16, the visual image forming apparatus 1C includes a changing unit 6 that changes transfer-process currents I(Y), I(M), I(C), and I(K), which are supplied to the transfer rollers of the transfer devices 75 by a feeding device 18 when the waste toner images are formed on the photoconductors 21 of the four image forming devices 20 (Y, M, C, and K). The transfer-process currents I(Y), I(M), I(C), and I(K) are changed to adjust the amounts received by the first collection containers 61 (Y, M, C, and K) and the third collection container 67.

This changing unit 6 has substantially the same structure as that of the changing unit 6 according to the first exemplary embodiment.

The visual image forming apparatus 1C includes the third collection container 67 that is dedicated to receive substances including toners collected by the third cleaning device 76. Accordingly, the changing unit 6 of the third exemplary embodiment is configured to change the transfer-process currents I (Y, M, C, and K), which are supplied when the waste toner images are formed, at least from a first transfer current to a second transfer current (see FIG. 6A). The first transfer current is set to facilitate transfer of toners in the toner images to the transferring-and-transporting belt 71. The second transfer current is set to reduce transfer of the toners in the toner images to the transferring-and-transporting belt 71.

Here, "first-transfer-process current" in FIG. 6A may be read as "transfer-process current". In addition, "+α" is an example based on an assumption that the toners are charged to a negative polarity when used. The value of "+α" may be changed to a value appropriate for the direct transfer method.

An operation performed by the visual image forming apparatus 1C including the changing unit 6 according to the third exemplary embodiment when the waste toner images are formed is substantially similar to the operation performed by the visual image forming apparatus 1 according to the first exemplary embodiment (FIGS. 6A and 7).

Thus, the visual image forming apparatus 1C is also structured such that the changing unit 6 performs the control operation of changing the transfer-process currents supplied when the waste toner images are formed. Accordingly, the ratio between the amounts of toners in the waste toner images received by the first collection containers 61 (Y, M, C, and K) and the third collection container 67 is changed. As a result, the time of replacement of at least one of the first collection containers 61 (Y, M, C, and K) and the third collection container 67 is adjusted.

Also in the visual image forming apparatus 1C, when the changing unit 6 changes the transfer-process currents supplied to the transfer devices 75 from the first transfer current to the second transfer current, the ratio of the amount of toners in the waste toner images that are received by the third collection container 67 is reduced during the operation (see FIG. 6B). Therefore, the time of replacement of the third collection container 67 may be delayed compared to when the transfer-process currents are not changed. In other words, in this case, the times of replacement of the first collection containers 61 (Y, M, C, and K) are somewhat advanced compared to when the transfer-process currents are not changed.

Modification of Third Exemplary Embodiment

The changing unit 6 of the visual image forming apparatus 1C according to the third exemplary embodiment may instead make changes illustrated in FIGS. 8A, 8B, and 9.

The changes made by the changing unit 6 of this modification are substantially similar to those made by the changing unit 6 of the modification of the visual image forming apparatus 1 according to the first exemplary embodiment. More specifically, the changing unit 6 changes the transfer-process currents when the detector 19, which detects the amounts of substances including toners contained in the first collection containers 61 (Y, M, C, and K) and the third collection container 67, detects a predetermined nearly full amount, which indicates a nearly full state.

Similar to the visual image forming apparatus 1 according to the first exemplary embodiment, the changing unit 6 according to this modification is structured based on the assumption that the first collection container 61K of the image forming device 20K, which is one of the four image forming devices 20, has a capacity greater than the capacities of the first collection containers 61 (Y, M, and C) of the other image forming devices 20 (Y, M, and C).

For example, the changing unit 6 according to this modification changes the transfer-process currents I (Y, M, C, and K) from the first transfer current to the second transfer current when the predetermined nearly full amount, which indicates a nearly full state, is detected by the detector 19. The second transfer current is set to zero, at which no transfer current is supplied to the transfer devices 75 (see FIG. 8A). The changing unit 6 according to this modification sets the first transfer current to, for example, a current of a positive polarity (+α) so that the reception ratio of the third collection container 67 is greater than the those of the first collection containers 61 (Y, M, C, and K), and sets the second transfer current for the remaining image forming devices 20 (Y, M, and C) to a current equal to the first transfer current (see FIG. 8A).

An operation performed by the visual image forming apparatus 1C including the changing unit 6 of this modification when the waste toner images are formed is also substantially similar to the operation according to the modification of the visual image forming apparatus 1 according to the first exemplary embodiment (FIGS. 8A and 9).

Thus, the visual image forming apparatus 1C including the changing unit 6 according to this modification is also structured such that the changing unit 6 performs the control operation of changing the transfer-process currents supplied when the waste toner images are formed. Accordingly, the ratio between the amounts of toners in the waste toner images received by the first collection containers 61 (Y, M, C, and K) and the third collection container 67 is changed. As a result, the time of replacement of at least one of the first collection containers 61 (Y, M, C, and K) and the third collection container 67 is adjusted.

In addition, in the case where the changing unit 6 of the modification changes the transfer-process currents from the first transfer current to the second transfer current as in the above-described example, the third collection container 67 initially receives a large amount of toners in the waste toner images. Then, after the amount of contents of the third collection container 67 reaches a nearly full amount, the amount received by the first collection container 61K for black, which has a relatively large capacity, is increased. Therefore, in this case, the time of replacement of the first collection containers 61 (Y, M, C, and K) may be delayed compared to when the transfer-process currents are not changed at all. In other words, in this case, the time of replacement of the third collection container 67 is somewhat advanced compared to when the transfer-process currents are not changed.

Fourth Exemplary Embodiment

Figure 17:
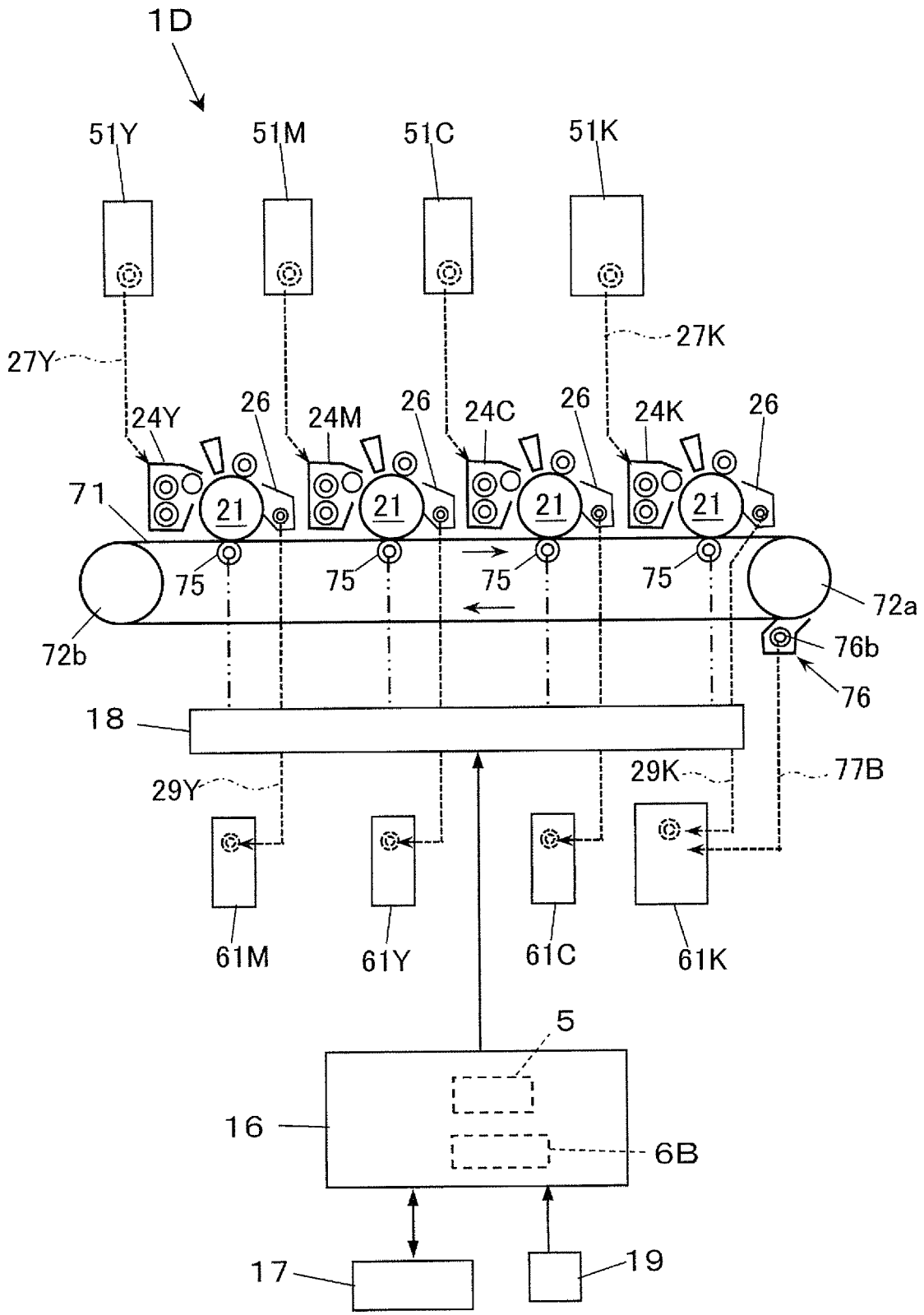
FIG. 17 is a schematic diagram illustrating the structure of a changing unit included in a visual image forming apparatus according to a fourth exemplary embodiment.

FIG. 17 illustrates a visual image forming apparatus 1D according to a fourth exemplary embodiment as another example of an image forming apparatus.

The visual image forming apparatus 1D according to the fourth exemplary embodiment has the same structure as that of the visual image forming apparatus 1C according to the third exemplary embodiment except that the visual image forming apparatus 1D does not include the third collection container 67 for receiving unnecessary substances, such as toners, collected by the third cleaning device 76 for the transferring-and-transporting belt 71 and includes a changing unit 6B that makes changes different from those made by the changing unit 6 according to the third exemplary embodiment.

As illustrated in FIG. 17, the visual image forming apparatus 1D does not include the third collection container 67 (FIG. 16) for receiving unnecessary substances, such as toners, collected by the third cleaning device 76. Instead, as illustrated in FIG. 17, the visual image forming apparatus 1D is structured such that, among the first collection containers 61 (Y, M, C, and K) of the image forming devices 20 (Y, M, C, and K), the first collection container 61K for black provided for the image forming device 20K has a capacity greater than those of the other first collection containers 61 (Y, M, and C) of the remaining image forming devices 20 (Y, M, and C). The first collection container 61K for black is configured to receive the unnecessary substances, such as toners, collected by the third cleaning device 76.

In accordance with the above-described structure, as illustrated in FIG. 17, the visual image forming apparatus 1D includes a third collecting transport unit 77B for transporting the unnecessary substances, such as toners, collected by the third cleaning device 76. The position, shape, etc. of the third collecting transport unit 77B are such that the third collecting transport unit 77B is connectable to a connecting portion of the first collection container 61K for black.

The changing unit 6B according to the fourth exemplary embodiment has substantially the same structure as that of the changing unit 6B according to the second exemplary embodiment.

The visual image forming apparatus 1D is structured such that the third collection container 67 dedicated to receive the substances including toners collected by the third cleaning device 76 is not provided, and that the substances including toners are instead received by the first collection container 61K that serves also as a third collection container. Accordingly, the changing unit 6B of the fourth exemplary embodiment is configured to change the transfer-process currents at least from a first transfer current to a second transfer current. The first transfer current is set to reduce transfer of the toners in the waste toner images to the transferring-and-transporting belt 71. The second transfer current is set to cause the toners in the waste toner images to be reversely transferred to the photoconductor 21 of at least one of the remaining image forming devices 20 (Y, M, and C) (see FIG. 13A).

An operation performed by the visual image forming apparatus 1D including the changing unit 6B according to the fourth exemplary embodiment when the waste toner images are formed is substantially similar to the operation performed by the visual image forming apparatus 1B according to the second exemplary embodiment (FIGS. 13A and 14).

Thus, the visual image forming apparatus 1D including the changing unit 6B is also structured such that the changing unit 6B performs the control operation of changing the transfer-process currents supplied when the waste toner images are formed. Accordingly, the ratio between the amounts of toners in the waste toner images received by the first collection containers 61 (Y, M, C, and K) is changed. As a result, the time of replacement of at least one of the first collection containers 61 (Y, M, C, and K) is efficiently adjusted by utilizing the first collection container 61Y for yellow, which has the smallest amount of toner contained therein.

In particular, in this case, the time of replacement of the first collection container 61K for black, which has the largest capacity, may be somewhat delayed compared to when the changing unit 6B does not change the transfer-process currents.

Fifth Exemplary Embodiment

Figure 18:
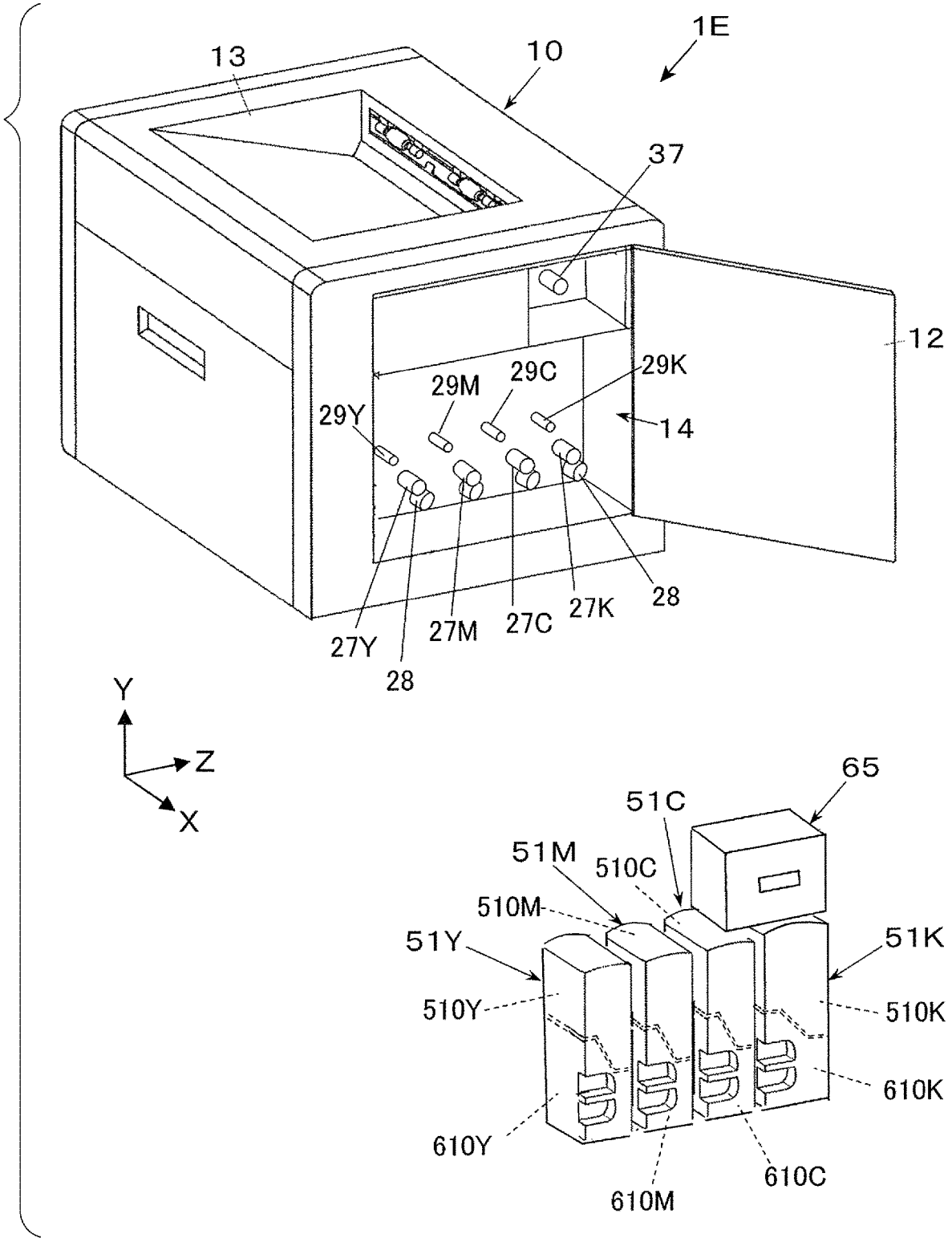
FIG. 18 is a perspective view of a visual image forming apparatus according to a fifth exemplary embodiment in a state in which a side covering is opened.
Figure 19:
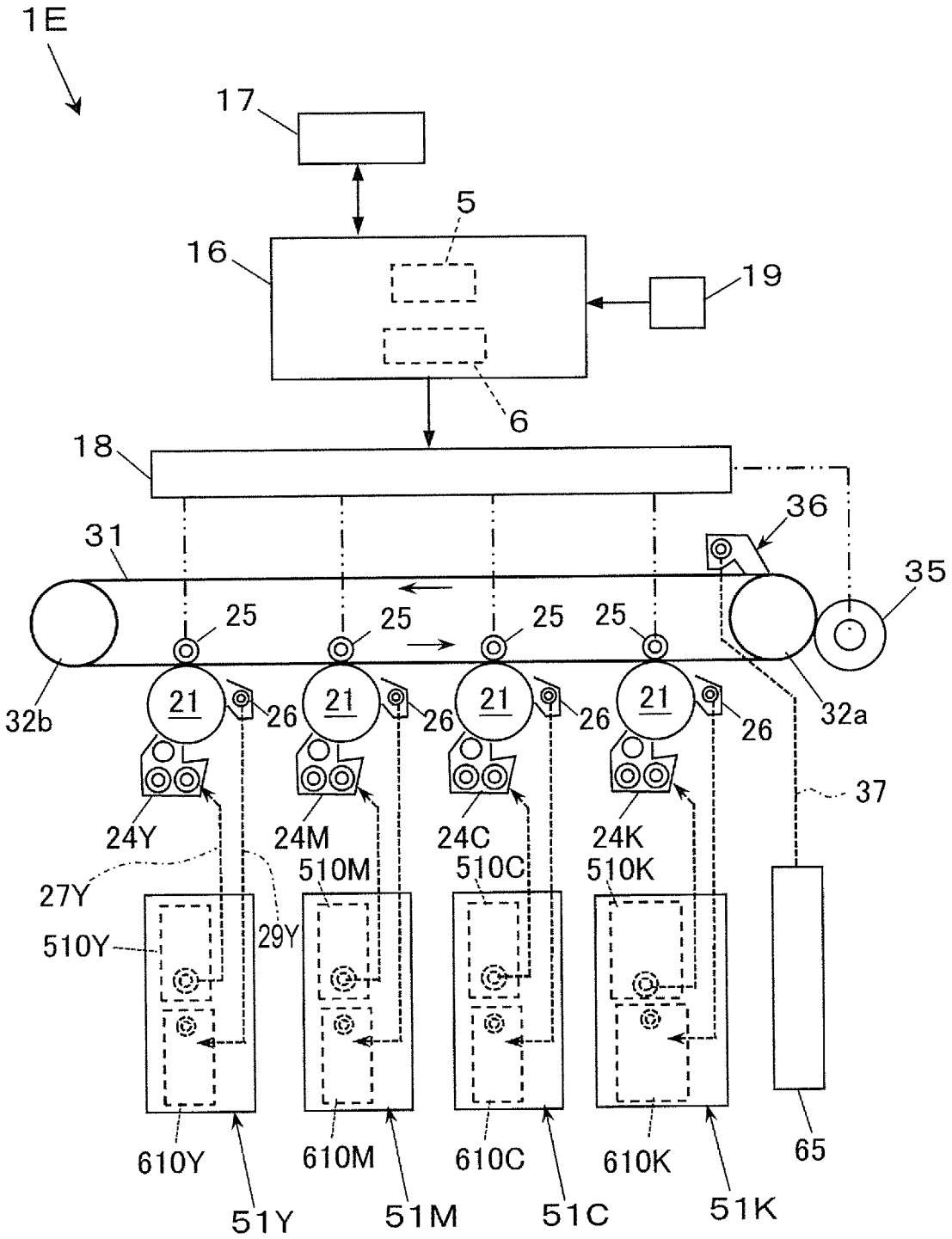
FIG. 19 is a schematic diagram illustrating the structure related to a changing unit included in the visual image forming apparatus illustrated in FIG. 18.

FIGS. 18 and 19 illustrate a visual image forming apparatus 1E according to a fifth exemplary embodiment as another example of an image forming apparatus.

The visual image forming apparatus 1E according to the fifth exemplary embodiment has the same structure as that of the visual image forming apparatus 1 according to the first exemplary embodiment except that the developer containers 51 (Y, M, C, and K) and the first collection containers 61 (Y, M, C, and K), which are independent containers, are replaced by developer containers 51 (Y, M, C, and K) including supply container portions 510Y, 510M, 510C, and 510K and collection container portions 610Y, 610M, 610C, and 610K. The supply container portions 510Y, 510M, 510C, and 510K respectively contain powders to be supplied to the developing devices 24 (Y, M, C, and K). The collection container portions 610Y, 610M, 610C, and 610K respectively receive substances including toners collected by the first cleaning devices 26 (Y, M, C, and K).

In the fifth exemplary embodiment, the first collection containers 61 (Y, M, C, and K), which are independent containers, are replaced by the collection container portions 610Y, 610M, 610C, and 610K integrated with the developer containers 51 (Y, M, C, and K).

Similar to the visual image forming apparatus 1 according to the first exemplary embodiment, the visual image forming apparatus 1E is also configured to form waste toner images, which are examples of a waste powder image to be discarded (collected) without being transferred onto the paper sheet 9.

The visual image forming apparatus 1E includes a changing unit 6 (see FIG. 19) that changes first-transfer-process currents I(Y), I(M), I(C), and I(K), which are supplied to the first transfer rollers of the first transfer devices 25 by the feeding device 18 when the waste toner images are formed on the photoconductors 21 of the four image forming devices 20 (Y, M, C, and K). The first-transfer-process currents I(Y), I(M), I(C), and I(K) are changed to adjust the amounts received by the collection container portions 610Y, 610M, 610C, and 610K, which are integrated with the developer containers 51 (Y, M, C, and K), and the second collection container 65.

This changing unit 6 has substantially the same structure as that of the changing unit 6 according to the first exemplary embodiment.

An operation performed by the visual image forming apparatus 1E including the changing unit 6 according to the fifth exemplary embodiment when the waste toner images are formed is substantially similar to the operation performed by the visual image forming apparatus 1 according to the first exemplary embodiment (FIGS. 6A and 7).

Thus, the visual image forming apparatus 1E is also structured such that the changing unit 6 performs the control operation of changing the first-transfer-process currents supplied when the waste toner images are formed. Accordingly, the ratio between the amounts of toners in the waste toner images received by the collection container portions 610 (Y, M, C, and K) of the developer containers 51 (Y, M, C, and K) and the second collection container 65 is changed. As a result, the time of replacement of at least one of the developer containers 51 (Y, M, C, and K) including the collection container portions 610 (Y, M, C, and K) and the second collection container 65 is adjusted.

When the changing unit 6 changes the first-transfer-process currents from the first transfer current to the second transfer current as in the above-described example of the first exemplary embodiment, the ratio of the amount of toners in the waste toner images that are received by the second collection container 65 is reduced during the operation. Therefore, the time of replacement of the second collection container 65 may be delayed compared to when the first-transfer-process currents are not changed.

In addition, according to the visual image forming apparatus 1E, the amounts (remaining amounts) of new and unused toners that remain in the supply container portions 510Y, 510M, 510C, and 510K at the time of replacement of the developer containers 51 (Y, M, C, and K) are less than when the amounts of substances including toners received by the collection container portions 610 (Y, M, C, and K) of the developer containers 51 (Y, M, C, and K) and the second collection container 65 are not controlled.

In other words, the amounts of toners that remain in the supply container portions 510Y, 510M, 510C, and 510K at the time of replacement of the developer containers 51 (Y, M, C, and K) including the supply container portions 510Y, 510M, 510C, and 510K and the collection container portions 610Y, 610M, 610C, and 610K may be reduced so that the toners are substantially entirely consumed.

The developer containers 51 (Y, M, C, and K) including the supply container portions 510Y, 510M, 510C, and 510K and the collection container portions 610Y, 610M, 610C, and 610K may be applied to the visual image forming apparatuses 1B, 1C, and 1D according to the second, third, and fourth exemplary embodiments. In such a case, the above-described effects of the changing units 6 and 6B may also be obtained.

Other Modifications

The present disclosure is not limited to the examples described in the first to fifth exemplary embodiments in any way, and alterations are possible without departing from the gist of the present disclosure. For example, modifications described below are also included.

In the first to fourth exemplary embodiments, the same number of first collection containers 61 (Y, M, C, and K) as the number of first cleaning devices 26 are provided as the first collection containers 61 dedicated to receive the substances including toners collected by the respective ones of the first cleaning devices 26. However, the first collection containers 61 may be replaced by a single first collection container 61 or a smaller number of first collection containers 61 than the number of first cleaning devices 26.

The visual image forming apparatuses 1, 1B, 1C, 1D, and 1E according to the first to fifth exemplary embodiments each include four image forming devices 20 (Y, M, C, and K). However, the number of image forming devices 20 included in the visual image forming apparatus may be other than four. The visual image forming apparatus may instead include a single image forming device 20.

In the first to fifth exemplary embodiments, the transfer-process biases changed by the changing units 6 and 6B are the transfer-process currents. However, the transfer-process biases to be changed may instead be transfer-process voltages supplied by the feeding device 18. Also when the transfer-process biases are transfer-process voltages, the changing units 6 and 6B may change the transfer-process voltages to adjust the amounts of powders received by the first collection containers and the second collection container, or by the first collection containers and the third collection container.

In the first to fifth exemplary embodiments, the visual image forming apparatuses 1, 1B, 1C, 1D, and 1E that utilize powders, which are developers, are described as examples of an image forming apparatus. However, the image forming apparatus according to the present disclosure may be any apparatus including a transfer device that electrostatically applies powder to a sheet-shaped object. Other examples of the image forming apparatus include a powder painting apparatus including a transfer device that electrostatically applies powder paint to a sheet-shaped object.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image carrier configured to carry an image;

a developing device configured to develop a latent image formed on the image carrier into a visible image formed of powder;

an intermediate transfer body configured to temporarily transport the visible image transferred from the image carrier;

a transfer device configured to transfer the visible image on the image carrier to the intermediate transfer body;

a first cleaning device configured to clean the image carrier by collecting powder that remains on the image carrier;

a first collection container configured to receive the powder collected by the first cleaning device;

a second cleaning device configured to clean the intermediate transfer body by collecting powder that remains on the intermediate transfer body;

a second collection container configured to receive the powder collected by the second cleaning device;

a feeding device configured to supply a transfer-process bias to the transfer device; and a changing unit configured to change the transfer-process bias supplied by the feeding device when a waste powder image is formed on the image carrier, the transfer-process bias being changed so as to adjust amounts of powder in the waste powder image received by the first collection container and the second collection container.

2. The image forming apparatus according to claim 1, wherein a plurality of image forming devices are arranged next to each other in a transporting direction of the intermediate transfer body, each of the image forming devices including the image carrier, the developing device, the transfer device, the first cleaning device, and the first collection container, wherein the image forming apparatus further comprises a transport path configured to transport the powder collected by the second cleaning device to the first collection container of one of the image forming devices, and wherein the changing unit is configured to change the transfer-process bias supplied to each of the transfer devices of the image forming devices when waste powder images are formed on the image carriers, the transfer-process bias being changed so as to adjust amounts of powder in the waste powder images received by the first collection container of the one of the image forming devices and the first collection container of remaining one or more of the image forming devices other than the one of the image forming devices.

3. The image forming apparatus according to claim 1, wherein the changing unit changes is configured to change the transfer-process bias at least from a first transfer bias to a second transfer bias, the first transfer bias being set to facilitate transfer of the powder in the waste powder image to the intermediate transfer body, the second transfer bias being set to reduce transfer of the powder in the waste powder image to the intermediate transfer body.

4. The image forming apparatus according to claim 2, wherein the changing unit is configured to change the transfer-process bias at least from a first transfer bias to a second transfer bias, the first transfer bias being set to reduce transfer of the powder in the waste powder images to the intermediate transfer body, the second transfer bias being set to cause the powder in the waste powder images to be reversely transferred to the image carrier of at least one of the remaining one or more of the image forming devices.

5. The image forming apparatus according to claim 4, wherein the changing unit is configured to, if the remaining one or more of the image forming devices include a plurality of remaining image forming devices, set the second transfer bias to cause the powder in the waste powder images to be reversely transferred only to the image carrier of one of the remaining image forming devices including the first collection container containing a smallest amount of powder.

6. The image forming apparatus according to claim 1, wherein the changing unit is configured to change the transfer-process bias using an amount of powder used to form the waste powder image.

7. The image forming apparatus according to claim 3, wherein the changing unit is configured to change the transfer-process bias using an amount of powder used to form the waste powder image.

8. The image forming apparatus according to claim 6, wherein the changing unit is configured to change the transfer-process bias if a number of times the waste powder image is formed reaches a predetermined number.

9. The image forming apparatus according to claim 1, further comprising:

a detector configured to detect an amount of powder contained in the first collection container or the second collection container, wherein the changing unit is configured to change the transfer-process bias if the amount of powder detected by the detector is a predetermined nearly full amount that indicates a nearly full state.

10. The image forming apparatus according to claim 3, wherein a plurality of image forming devices are arranged next to each other in a transporting direction of the intermediate transfer body, each of the image forming devices including the image carrier, the developing device, the transfer device, the first cleaning device, and the first collection container, wherein the image forming apparatus further comprises a detector configured to detect an amount of powder contained in each of the first collection containers of the image forming devices or the second collection container, wherein the first collection container of one of the image forming devices has a capacity greater than a capacity of the first collection container of remaining one or more of the image forming devices other than the one of the image forming devices, and wherein the changing unit is configured to change the transfer-process bias from the first transfer bias to the second transfer bias if the amount of powder detected by the detector is a predetermined nearly full amount that indicates a nearly full state, the second transfer bias being set to cause the powder to be reversely transferred to the image carrier of the one of the image forming devices.

11. The image forming apparatus according to claim 2, further comprising:

a detector configured to detect an amount of powder contained in each of the first collection containers of the image forming devices, wherein the changing unit is configured to change the transfer-process bias if the amount of powder contained in the first collection container of the one of the image forming devices is a predetermined nearly full amount that indicates a nearly full state.

12. The image forming apparatus according to claim 1, wherein the image forming apparatus includes a powder container including a supply container portion that contains powder to be supplied to the developing device, and wherein the first collection container is formed as a collection container portion that is integrated with the powder container.

13. The image forming apparatus according to claim 1, wherein the waste powder image is configured to be collected without being transferred to any paper sheet.

14. The image forming apparatus according to claim 13, wherein the changing unit is configured to change the transfer-process bias so as to adjust amounts of powder in the waste powder image received by the first collection container and the second collection container only when a waste powder image is formed on the image carrier in periods other than periods for forming normal toner images.

15. The image forming apparatus according to claim 1, wherein the second cleaning device contacts the intermediate transfer body.

16. An image forming apparatus comprising:

an image carrier configured to carry an image;

a developing device configured to develop a latent image formed on the image carrier into a visible image formed of powder;

a transferring-and-transporting body configured to transport a sheet-shaped object;

a transfer device configured to transfer the visible image to the sheet-shaped object transported by the transferring-and-transporting body;

a first cleaning device configured to clean the image carrier by collecting powder that remains on the image carrier;

a first collection container configured to receive the powder collected by the first cleaning device;

a third cleaning device configured to clean the transferring-and-transporting body by collecting powder that remains on the transferring-and-transporting body;

a third collection container configured to receive the powder collected by the third cleaning device;

a feeding device configured to supply a transfer-process bias to the transfer device; and a changing unit configured to change the transfer-process bias supplied by the feeding device when a waste powder image is formed on the image carrier, the transfer-process bias being changed so as to adjust amounts of powder in the waste powder image received by the first collection container and the third collection container.

17. The image forming apparatus according to claim 16, wherein a plurality of image forming devices are arranged next to each other in a transporting direction of the transferring-and-transporting body, each of the image forming devices including the image carrier, the developing device, the transfer device, the first cleaning device, and the first collection container, wherein the image forming apparatus further comprises a transport path configured to transport which the powder collected by the third cleaning device to the first collection container of one of the image forming devices, and wherein the changing unit is configured to change the transfer-process bias supplied to each of the transfer devices of the image forming devices when waste powder images are formed on the image carriers, the transfer-process bias being changed so as to adjust amounts of powder in the waste powder images received by the first collection container of the one of the image forming devices and the first collection container of remaining one or more of the image forming devices other than the one of the image forming devices.

18. The image forming apparatus according to claim 16, wherein the changing unit is configured to change the transfer-process bias at least from a first transfer bias to a second transfer bias, the first transfer bias being set to facilitate transfer of the powder in the waste powder image to the transferring-and-transporting body, the second transfer bias being set to reduce transfer of the powder in the waste powder image to the transferring-and-transporting body.

19. The image forming apparatus according to claim 17, wherein the changing unit is configured to change the transfer-process bias at least from a first transfer bias to a second transfer bias, the first transfer bias being set to reduce transfer of the powder in the waste powder images to the transferring-and-transporting body, the second transfer bias being set to cause the powder in the waste powder images to be reversely transferred to the image carrier of at least one of the remaining one or more of the image forming devices.

20. The image forming apparatus according to claim 19, wherein the changing unit is configured to, if the remaining one or more of the image forming devices include a plurality of remaining image forming devices, set the second transfer bias to cause the powder in the waste powder images to be reversely transferred only to the image carrier of one of the remaining image forming devices including the first collection container containing a smallest amount of powder.

21. The image forming apparatus according to claim 16, wherein the changing unit is configured to change the transfer-process bias using an amount of powder used to form the waste powder image.

22. The image forming apparatus according to claim 18, wherein the changing unit is configured to change the transfer-process bias using an amount of powder used to form the waste powder image.

23. The image forming apparatus according to claim 4, further comprising:

a detector configured to detect an amount of powder contained in each of the first collection containers of the image forming devices, wherein the changing unit is configured to change the transfer-process bias from the first transfer bias to the second transfer bias if the amount of powder detected by the detector is a predetermined nearly full amount that indicates a nearly full state, and wherein the changing unit is configured to, if the remaining one or more of the image forming devices include a plurality of remaining image forming devices, set the second transfer bias to cause the powder to be reversely transferred to the image carrier only by the transfer device of one of the remaining image forming devices including the first collection container containing a smallest amount of powder.

* * * * *